US006272302B1

(12) United States Patent
Yamamoto

(10) Patent No.: US 6,272,302 B1
(45) Date of Patent: Aug. 7, 2001

(54) IMAGE FORMING APPARATUS WITH DEVELOPER COLLECTING ROLLER

(75) Inventor: Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/519,992

(22) Filed: Mar. 7, 2000

(30) Foreign Application Priority Data

Mar. 9, 1999 (JP) ..... 11-062044
Aug. 5, 1999 (JP) ..... 11-222789

(51) Int. Cl.[7] ..... G03G 15/08
(52) U.S. Cl. ..... 399/150; 399/283; 399/357
(58) Field of Search ..... 399/149, 150, 399/264, 273, 283, 357

(56) References Cited

U.S. PATENT DOCUMENTS 3,914,045 * 10/1975 Namiki et al. ..... 399/149
4,664,504 * 5/1987 Oda et al. ..... 399/149
5,570,164 * 10/1996 Yamamoto et al. ..... 399/283
5,835,819 11/1998 Yamamoto ..... 399/51

FOREIGN PATENT DOCUMENTS 58-116559 7/1983 (JP) .

* cited by examiner

*Primary Examiner*—Joan Pendegrass
(74) *Attorney, Agent, or Firm*—Fitzpatrick, Cella, Harper & Scinto

(57) ABSTRACT

The present invention relates to an image forming apparatus in which a developing device has a developer bearing member for bearing and carrying a developer thereon, which is provided in opposed relationship with an image bearing member; and developer collecting means provided in opposed relationship with the developer bearing member and the image bearing member, and the developer collecting means collects any unused developer on the developer bearing member and any untransferred developer on the image bearing member.

19 Claims, 14 Drawing Sheets

IMAGE FORMING APPARATUS WITH DEVELOPER COLLECTING ROLLER

BACKGROUND OF THE INVENTION

1. Field of the Invention

This invention relates to an image forming apparatus for use in an electrophotographic apparatus, an electrostatic recording apparatus or the like.

2. Related Background Art

In an image forming apparatus utilizing the electrophotographic process, an electrostatic latent image is formed on an image bearing member such as a photosensitive drum, and this electrostatic latent image is developed and visualized by the use of a developer, and the thus obtained visible image (toner image) is transferred to a transfer material to thereby obtain an image.

As developing methods, there are generally a monocomponent developing method using a monocomponent developer comprising only a toner, and a two-component developing method using a two-component developer comprising a magnetic carrier (magnetic particles) and a toner, but the monocomponent developing method is simpler in the construction of a developing device and easier in maintenance and therefore, many developing devices based on the monocomponent developing method have been proposed.

Japanese Patent Application Laid-Open No. 58-116559 proposes a non-magnetic monocomponent developing method of effecting development by the use of not a magnetic toner but a non-magnetic toner, and according to this developing method, it is possible to obtain color images satisfying the recent requirement for the quality of image and moreover, a low-cost and compact developing device is realized.

FIG. 9 of the accompanying drawings shows a developing device using the non-magnetic monocomponent developing method which is installed in an image forming apparatus. This developing device E has a developing roller 1 rotatively driven in the direction of the arrow as a developer bearing member in the opening portion of a developer container 3 containing a non-magnetic toner (a non-magnetic monocomponent developer) therein, and a toner supplying and collecting roller 19 as a developer supplying and collecting member and a regulating blade 20 as a developer regulating member abut against the developing roller 1.

The toner supplying and collecting roller 19 comprises a mandrel 19*a* of SUS or like material and an elastic member 19*b* of urethane foam or like material covering the outer peripheral surface of the mandrel 19. The roller 19 elastically abuts against the surface of the developing roller 1 by the elastic member 19*b* and rotates to thereby supply a non-magnetic toner contained in the developer container 3 to the surface of the developing roller 1, and also scrapes any unused toner returned to the developer container 3 with the rotation of the developing roller 1 without being used in development from the surface of the developing roller 1.

The regulating blade 20 comprises a support member 20*a* formed of phosphor bronze or the like and an elastic member 20*b* of urethane rubber or like material adhesively secured to the support member 20*a*. The blade 20 acts to elastically abut against the surface of the developing roller 1 by the elastic member 20*b* and regulates the toner borne on the developing roller 1 to thereby form a thin layer of toner and impart charges to the toner.

An image forming apparatus using the above-described developing device E will now be described with reference to FIG. 10 of the accompanying drawings. As shown in FIG. 10, the image forming apparatus has a photosensitive drum 11 as an image bearing member rotatively driven at a predetermined peripheral speed in the direction of the arrow, and a charging device 16, an exposing device 15, the developing device E and a cleaning device 18 are disposed around the photosensitive drum 11.

To form an image, the photosensitive drum 11 is first rotated and in the rotation process thereof, the surface of the photosensitive drum 11 is uniformly charged to a desired polarity and potential by the charging device 16, and then image exposure conforming to desired image data is effected by the exposing device 15 to thereby form an electrostatic latent image on the surface of the photosensitive drum 11. Next, in a developing portion wherein the photosensitive drum 11 and the developing roller 1 of the developing device E are opposed to each other, the electrostatic latent image on the photosensitive drum 11 is developed by the non-magnetic toner on the developing roller 1 to thereby form on the photosensitive drum 11 a toner image conforming to the electrostatic latent image.

A transfer bias is then applied to a transfer roller 13 to thereby transfer this toner image to a transfer material P conveyed to a transfer portion in which the photosensitive drum 11 and the transfer roller 13 are opposed to each other. Thereafter, the transfer material P is introduced into a fixing device 14, where the toner image is heated and fixed on the transfer material P, whereby an image is obtained on the transfer material P, thus completing a series of image forming steps.

After the transfer, the photosensitive drum 11 has any untransferred toner residual on its surface without being transferred removed and collected by the cleaning device 18, and thereafter is used again for the image forming steps of charging, exposing, developing, etc. similar to those described above.

In recent years, the further downsizing and lower cost of the above-described image forming apparatus using the non-magnetic monocomponent developing method have been desired and the shortening of the image forming steps (including the omission of some of the steps) has been variously studied.

There has been proposed a cleanerless image forming apparatus in which of the above-described image forming steps, the cleaning step is omitted, but if the cleaning device 18 is simply omitted, there have been the following problems.

If the cleaning means for cleaning the surface of the photosensitive drum 1 is absent, untransferred toner, paper powder, etc. accumulate on the photosensitive drum and prevents uniform charging and image exposure for forming the electrostatic latent image and therefore, the unevenness of potential occurs to the electrostatic latent image and the unevenness of the density of an output image occurs.

Also, the developing device E effects the supply and collection of the toner to the developing roller 1 by the toner supplying and collecting roller 19 abutting against and frictionally rotating with the developing roller 1, and effects the imparting of charges to the toner by the contact friction when the toner passes the regulating blade 13 and therefore, toner in the developer container 3 is very great in a mechanical load applied thereto until it is used for the development on the photosensitive drum 11, and the damage to the toner is very great as compared with the other developing methods.

Further, depending on the disposed position and the direction of rotation of the toner supplying and collecting roller 19, the toner which did not contribute to the development cannot be completely collected and in some cases, the toner has been remaining on the developing roller 1. The toner residual on the developing roller 1 again passes the regulating blade 20 and is carried to a developing area, and if such a step is continuously repeated, an extraneous additive or the like controlling the charging amount and fluidity of the toner is buried into the interior of the toner by mechanical friction and the accumulation of heat, and it happens that the toner becomes a deteriorated toner of which the desired charging characteristic and fluidity cannot be obtained.

This deteriorated toner causes many problems during the image forming process. For example, when the deteriorated toner contributes to development, a proper developing characteristic is not obtained and therefore, bad development occurs or bad transfer such as a hollow image is sometimes caused. Further, the supply of fresh toner onto the developing roller 1 is hindered and the amount of toner coat (the applied amount) may be reduced to thereby cause bad density or the like. Also, when the deteriorated toner is fused on the nip portion of the regulating blade 20 and the surface of the developing roller 1, bad coat such as streaks occurs and also, the imparting of charges to the toner newly supplied onto the developing roller is hindered. Thus, uncharged toner is carried to the developing portion and a bad image such as fog or unevenness may be caused.

The above-described non-magnetic monocomponent developing method is not only great in the load applied to the toner, but also is great in the load applied to the developing device E itself, and when the sponge roller as described above is used as the toner supplying and collecting roller 19, if the frictional contact thereof with the developing roller 1 continues for a long time, the role thereof as the toner supplying and collecting roller will become insufficient due to the friction and damage of the developing roller itself and the clogging or the like of the toner, and good toner supply and collection may become impossible.

As described above, the monocomponent developing method using the non-magnetic toner is simple in the construction of the developing device and can accomplish good development, but is great in the load applied to the toner and the developing device, and is remarkably deficient in long-term stability and durability as compared with the magnetic monocomponent developing method and the two-component developing method. Accordingly, the non-magnetic monocomponent developing method is utilized chiefly in developing devices of the cartridge type in which the developing device is bodily interchanged during the replenishment of the toner supply, and is not so much adopted in developing devices of the type in which the toner supply is replenished as in a copier.

Further, in recent years, with a view to reduce power consumption, the development of a toner which can be fixed at a lower temperature has been progressed, and along therewith, a developing process of low stress corresponding to the toner for low temperature fixation is expected, but there is not yet available a non-magnetic monocomponent developing method provided with such a characteristic.

SUMMARY OF THE INVENTION

It is an object of the present invention to provide a cleanerless image forming apparatus in which a load applied to a toner is reduced.

It is another object of the present invention to provide an image forming apparatus in which when an image is to be formed by the use of a non-magnetic toner which is a monocomponent developer, a load applied to the toner during development, particularly a load applied to the toner during the imparting of charges and the supply of the toner to a developing roller can be remarkably reduced to thereby realize a low stress coat capable of coping with a toner for low temperature fixation, and a toner layer not including reversal toner and uncharged toner can be formed on the developing roller, and which can realize a cleanerless image forming process and can obtain images of high clarity for a long period of time as well as can realize compactness and low costs.

It is still another object of the present invention to provide an image forming apparatus comprising:

an image bearing member bearing a latent image thereon;

a developing device for developing the latent image borne on the image bearing member with a developer, the developing device having:

a developer bearing member bearing and carrying the developer thereon, the developer bearing member being provided in opposed relationship with the image bearing member; and developer collecting means provided in opposed relationship with the developer bearing member and the image bearing member; and transfer means for transferring a developer image obtained by developing the latent image by the developing device to a transfer material;

wherein the developer collecting means collects any unused developer in development on the developer bearing member and any untransferred developer on the image bearing member.

Other objects and features of the present invention will become more fully apparent from the following detailed description when read with reference to the accompanying drawings.

DESCRIPTION OF THE PREFERRED EMBODIMENTS

Some embodiments of the present invention will hereinafter be described in detail with reference to the drawings.

Embodiment 1

Figure 1:
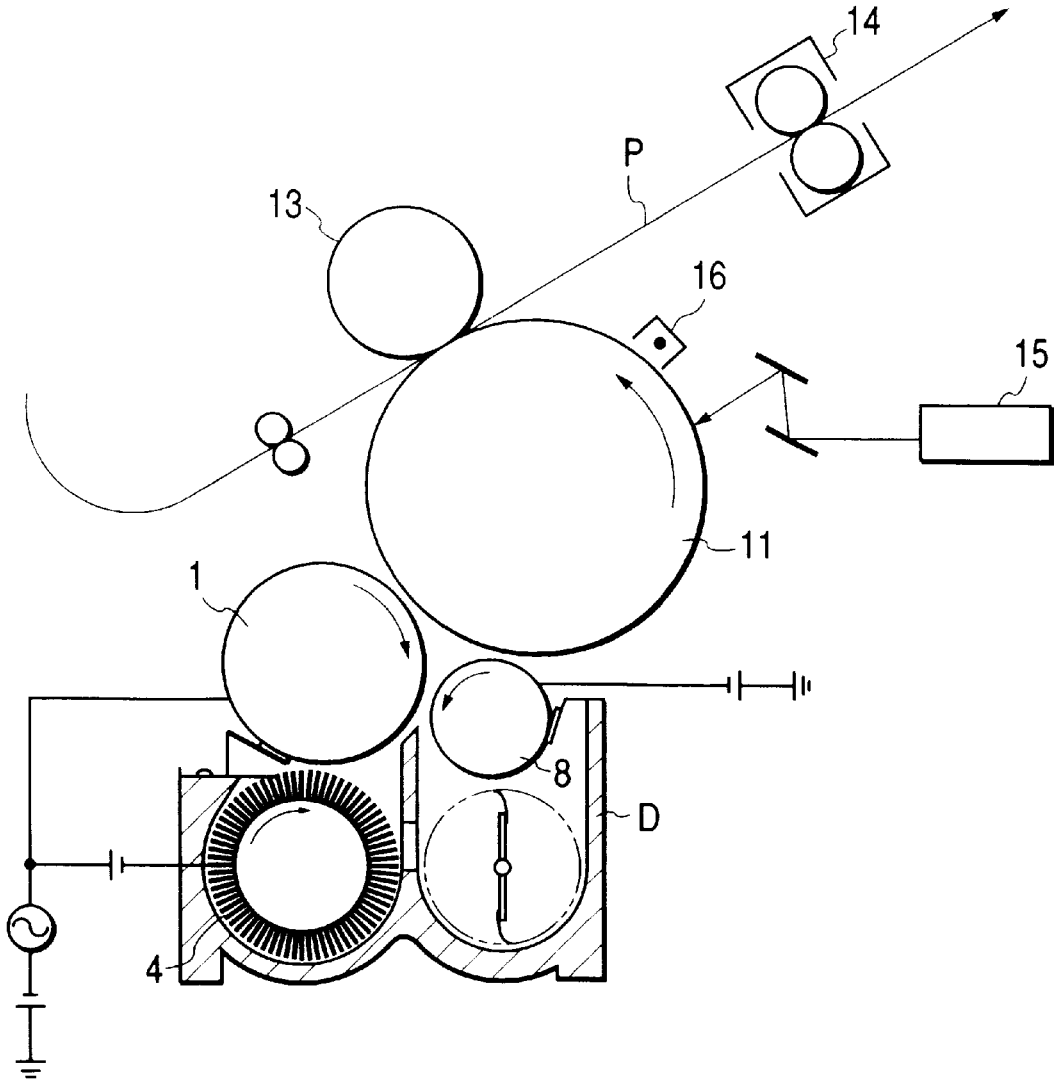
FIG. 1 schematically shows the construction of an embodiment of the image forming apparatus of the present invention.
Figure 2:
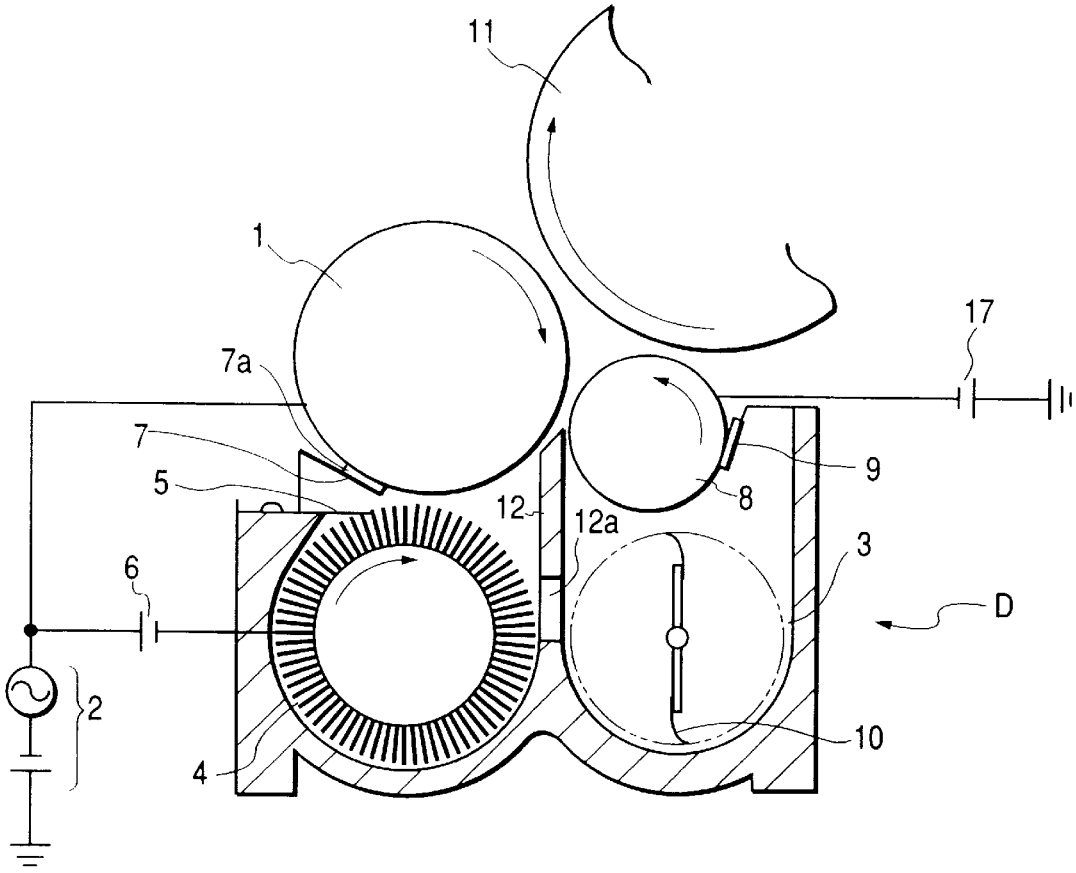
FIG. 2 is a cross-sectional view showing a developing device installed in the image forming apparatus of FIG. 1 on an enlarged scale.

FIG. 1 is a schematic cross-sectional view showing an embodiment of the image forming apparatus of the present invention, and FIG. 2 is a cross-sectional view showing a developing device installed in the image forming apparatus of FIG. 1 on an enlarged scale. The general construction of the image forming apparatus of the present invention will first be described with reference to FIG. 1.

In FIG. 1, the reference numeral 11 designates a photosensitive drum as an image bearing member which is rotatively driven at a predetermined peripheral speed in the direction of arrow. Around this photosensitive drum 11, there are disposed a charging device 16, an exposing device 15 and a developing device D.

To form an image, the photosensitive drum 11 is first rotated, and in the rotation process thereof, the surface of the photosensitive drum 11 is uniformly charged to a desired polarity and potential by the charging device 16, and then image exposure conforming to desired image data is effected by the exposing device 15 to thereby form an electrostatic latent image on the surface of the photosensitive drum 11. Next, in a developing portion wherein the photosensitive drum 11 and the developing roller 1 of the developing device D are opposed to each other, the electrostatic latent image on the photosensitive drum 11 is developed with a non-magnetic toner on the developing roller 1, whereby a toner image conforming to the electrostatic latent image is formed on the photosensitive drum 11.

During this development, any unused toner on the developing roller 1 which has not contributed to the development is caused to adhere to the toner collecting roller 8 of the developing device D and collected by an electric field formed by a bias applied to the developing roller 1 and a bias applied to the toner collecting roller 8, and is returned into the developing device D. The toner collecting roller 8 is disposed in opposed relationship with the developing roller 1 and the photosensitive drum 11.

The toner image formed on the photo-sensitive drum 11 is transferred to a transfer material P conveyed to a transfer portion in which the photosensitive drum 11 and a transfer roller 13 are opposed to each other by a transfer bias being applied to the transfer roller 13. Thereafter, this transfer material P is introduced into a fixing device 14, where the toner image is heated and fixed on the transfer material P, whereby an image is obtained on the transfer material P, thus completing a series of image forming steps.

If provision is made of cleaning means, the photosensitive drum 11 after the transfer has any untransferred toner residual on its surface without being transferred to the transfer material P removed and collected by the cleaning means, whereafter it is again used for the charging and exposing steps similar to those described above, but in the present invention, provision is not made of cleaning means exclusively for removing and collecting the untransferred toner and thus, the photosensitive drum 11 again proceeds to the charging and exposing steps while bearing the untransferred toner thereon.

Part of the untransferred toner having passed through the second charging and exposing steps with the photosensitive drum 11 is caused to adhere onto the toner collecting roller 8 and collected by an electric field formed by the potential made by an electrostatic latent image newly formed on the surface of the photosensitive drum 11 and a bias applied to the toner collecting roller 8 in the opposed portion to the toner collecting roller 8, and is returned into the developing device D.

As described above, according to the present invention, of the untransferred toner on the photosensitive drum 11, only the untransferred toner present on the non-image portion (non-exposed portion) of the new electrostatic latent image is removed and collected to the toner collecting roller 8 side. The remaining untransferred toner present on the image portion (exposed portion) of the new electrostatic latent image will later be used for development at the next developing step and therefore, will not affect the image formation even if it is introduced into the developing step while being borne on the photosensitive drum 11.

Thereafter, similar developing, transferring and fixing steps are effected on the new electrostatic latent image, and such image formation is repeated.

The developing device D used in the present invention and a cleanerless mechanism using this developing device D will hereinafter be described in detail.

As shown in FIG. 2, in the present invention, the developing device D has a developer container 3 containing therein a non-magnetic toner which is a non-magnetic monocomponent developer, and also has the developing roller 1, a toner supplying brush 4, a toner flow path control member 5, a toner regulating blade 7, the toner collecting roller 8, a toner stripping scraper 9 and a toner agitating member 10 provided in the developer container 3. The interior of the developer container 3 is partitioned by a partition member 12 extending to this side of an opening portion, and a communication port 12*a* is provided in the lower portion of the partition member 12.

The developing roller 1 is installed in the opening portion of the developer container 3 in opposed relationship with the photosensitive drum 11 with a predetermined interval therebetween, and is rotatively driven in the direction of the arrow. In the present embodiment, a metallic roller made of SUS, aluminum or the like is used as the developing roller 1. A power source 2 for applying a predetermined developing bias is connected to the developing roller 1.

This developing roller 1 need not always be made of a metal, but when for example, a contact developing method of effecting development with the developing roller 1 brought into contact with the photosensitive drum 11 with a developer interposed therebetween is adopted, the developing roller may be an elastic roller having one or more elastic layers on a mandrel. As the material of the elastic layer or layers, use can be made of an ordinary rubber material such as silicone rubber, NBR rubber, EPDM rubber or urethane rubber. The surface of the elastic layer or layers can be covered with electrically conductive resin comprising resin such as nylon having carbon or the like dispersed therein.

The rubber hardness of the elastic layer or layers may suitably be 20 to 70° as measured by a JIS-A rubber hardness meter with the electrically conductive film of the surface included. The surface roughness Rz of the elastic layer or layers may preferably be 1 to 20 $\mu$m with the carrying property of the toner taken into account, and the surface roughness Rz is specifically set in accordance with the particle diameter and shape of the toner used. The resistance value of the elastic developing roller may preferably be set so as to be volume resistivity of $10^3$ to $10^9$ Ωcm as measured with the electrically conductive film of the surface included.

The toner supplying brush 4 is for taking in the non-magnetic toner in the developer container 3 and supplying it to the developing roller 1, and is disposed for rotation in the same direction as the direction of rotation of the developing roller 1 (the opposite direction in the most proximate portion) with an interval of 100 $\mu$m to 1 mm between it and the developing roller 1. A voltage comprising a desired DC voltage Vf superimposed on a developing bias is applied to the mandrel of the toner supplying brush 4 by a voltage source 6, whereby a desired electric field is formed between it and the developing roller 1.

Figure 3A:
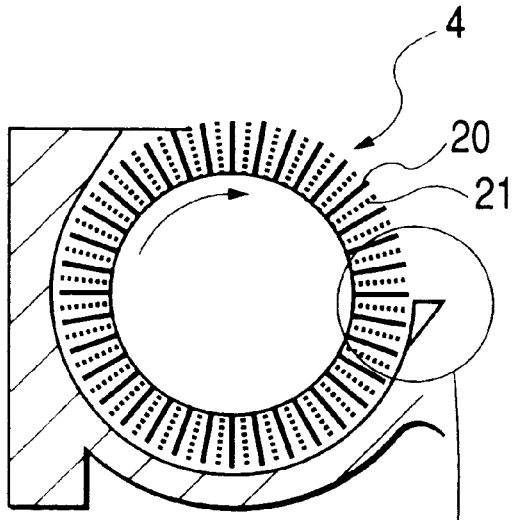
FIGS. 3A and 3B are illustrations showing a toner supplying brush installed in the developing device of FIG. 2 and the fibers thereof.
Figure 3B:
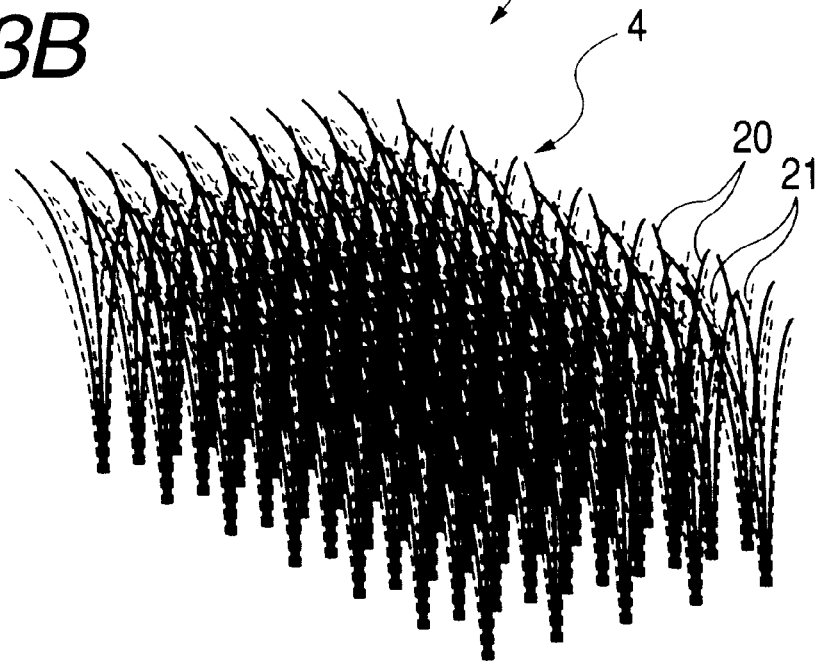

The fiber of the toner supplying brush 4 may only be an electrically conductive one, but in the present embodiment, as shown in FIGS. 3A and 3B, use is made of a fur brush comprising a brush member comprising electrically conductive fibers 20 of low resistance of the order of $10^2$ to $10^8$ Ωcm and insulative fibers 21 of high resistance of the order of $10^8$ to $10^{15}$ Ωcm mixed together, the brush member being twined around a metallic mandrel made of SUS or the like.

In the present embodiment, a toner having the negative charging polarity is used as the developer and therefore, it is preferable that the insulative fibers 21 have the positive charging polarity, and in the present embodiment, nylon fibers ($10^8$ to $10^{15}$ Ωcm) are used as the insulative fibers 21. Of course, this is not restrictive, but the kind of the insulative fibers can be selected in conformity with the characteristic of the toner, and in the case of the present embodiment, fibers such as rayon can also be used.

Figure 4:
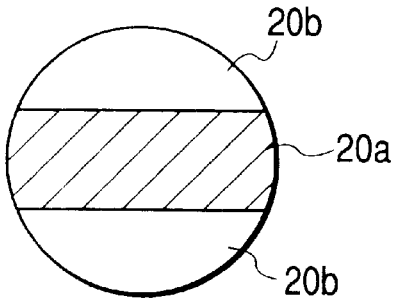
FIG. 4 is a cross-sectional view showing an example of the state of the cross-section of the electrically conductive fiber of the fibers of FIGS. 3A and 3B.

It is the first condition that the electrically conductive fibers 20 satisfy the resistance value within the above-mentioned range, but most of the electrically conductive fibers are often spun with an electrically conducting agent such as carbon dispersed in insulative resin which is an insulative fiber material, and the dispersing methods are various from one fiber manufacturer to another, and the electrically conducting agent is not always exposed on all the surface of monofilament. That is, as shown in FIG. 4 which shows the cross-section of the monofilament of the electrically conductive fibers 20, besides an electrically conducting portion 20*a*, insulating portions 20*b* are present on the surface of the monofilament. Accordingly, it is preferable that with the contact of the toner with the insulating portions 20*b* taken into account, resin of the positive charging property to the toner be chosen as the insulative resin for the electrically conductive fibers, and in the present embodiment, resin of nylon line is used.

In the present embodiment, the toner is made into a cloud-like state by the toner supplying brush 4 and is supplied to the developing roller 1. Therefore, both of the electrically conductive fibers 20 and the insulative fibers 21 of the brush 4 require elasticity, and the fineness thereof is of the order of 1 to 10 denier/filament ($0.11\times10^{-6}$ to $1.11\times10^{-6}$ kg/m/filament), and they were set so as to have implantation density of 1 to 200,000 lines/inch$^2$ in their mixed state and to have a pile length of 1 to 10 mm.

The toner flow path control member 5 is for making the toner from the toner supplying brush 4 into a cloud-like state and beating and driving out the toner toward the developing roller 1, and is disposed so as to contact with the toner supplying brush 4. In the present embodiment, a thin plate of a metal such as SUS or phosphor bronze having a thickness of the order of 100 $\mu$m to 1 mm is used as the toner flow path control member 5. While the toner flow path control member 5 assumes a straight shape by the thin plate, this is not restrictive, but depending on the direction in which the toner is made into a cloud-like state, it can also be molded into a shape suited therefor.

On the surface of contact of the toner flow path control member 5 with the toner supplying brush 4, with the imparting of charges to the toner intervening therebetween taken into account, resin high in the potentiality of imparting charges to the toner, e.g., resin comprising nylon having carbon dispersed therein and having its resistance value adjusted to the order of $10^5$ Ωcm, may be layered. Thereby, the imparting of charges to the toner by the toner flow path control member 5 is added and the imparting of charges to the toner is further stabilized.

The regulating blade 7 as toner regulating means is for regulating the layer thickness of the toner applied onto the developing roller 1, and in the present embodiment, use is made of a blade comprising an elastic member 7*a* of a rubber material such as urethane rubber or silicone rubber of JIS hardness 50° to 70° layered on the fore end of a metallic thin plate having a thickness of the order of 0.1 mm, and this blade is disposed so as to abut against the developing roller 1.

When the aforedescribed elastic roller is used as the developing roller 1, it is preferable that a metallic thin plate having a thickness of the order of 0.1 mm be used as the toner regulating blade 7. In this case, the toner regulating blade may preferably be formed into a shape bent in the opposite direction to the developing roller 1 at a location of about 2 mm from the tip end portion thereof, and the bent portion may preferably contact with the developing roller 1 so as to press against the latter with line pressure of about 20 g/cm.

The toner collecting roller 8 is for electrostatically collecting the untransferred toner residual on the photosensitive drum 11 in the transfer portion and the unused toner remaining on the developing roller 1 without contributing to development in the developing portion, and is installed in opposed relationship with the developing roller 1 and the photosensitive drum 11 with an interval of 100 $\mu$m to 1 mm with respect to the former and an interval of 100 $\mu$m to 1 mm with respect to the latter so as to be rotatable in the direction opposite to the direction of rotation of the developing roller 1 and the photosensitive drum 11 (the same direction in the most proximate portion) as indicated by arrow. A construction in which a desired bias is applied by a power source 17 is adopted.

While in the present embodiment, the toner collecting roller 8 is constructed by working the surface of a metal roller into a mirror surface, surface processing by fluorine resin such as Teflon may be effected on the surface of the metal roller with the collection efficiency of the toner taken into account. For example, a roller surface obtained by subjecting the surface of the metal roller to quench plating process and melting fluorine resin into cracks in the plated surface formed at that time is high in the parting property relative to the toner, and it becomes easier to collect the unused toner in development by the electric field concentrating effect by the fluorine resin (insulating portion) and the plated portion (electrically conducting portion). By effecting such surface processing, the wear resistance of the roller surface is also improved.

The scraper 9 as toner stripping means is for removing the toner collected by and adhering to the toner collecting roller 8 from the surface of the roller 8, and returning it to a toner containing portion A, and in the present embodiment, the scraper 9 is formed of a rubber material such as urethane rubber or silicone rubber, and is disposed so as to edge-abut against the surface of the toner collecting roller 8 by its tip end.

The rubber material forming the scraper 9 may preferably have rubber hardness of 50° to 70° in terms of JIS hardness so as to be capable of mechanically scraping off the toner from the toner collecting roller 8. The edge position of the scraper 9 is set to the position of the lower half round of the toner collecting roller 8 so that the scraped-off toner may be reliably returned to the toner containing portion A.

The partition member 12 is provided up to a location below that portion of the developing roller 1 which is opposed to the toner collecting roller 8, and partitions the space between the toner containing portion A and the toner supplying portion B so as to prevent the toner scraped off from the toner collecting roller 8 from scattering to the toner supplying portion B side. Accordingly, the returning of the unused toner in development to the toner containing portion A can be made more reliable.

The partition member 12 is also effective to prevent the toner from being made into a cloud-like state in the toner supplying portion B, which toner does not have desired charges, from passing through the gap between the developing roller 1 and the toner collecting roller 8 and scattering out of the developing device.

In the present embodiment, as the non-magnetic toner, use is made of a toner comprising polystyrene or polyester thermoplastic resin having a coloring agent and a negative charge control agent mixed and dispersed therein, and formed by crushing the resin and having a weight average particle diameter of 5 $\mu$m or larger. Also, an OPC photosensitive member is used as the photosensitive drum 11, and a reversal developing method of causing a non-magnetic toner of the negative polarity to adhere to the image exposing portion is adopted as a method of developing the image.

The interior of the developer container 3 can be conceptionally divided into three, i.e., an area A as a toner containing portion, an area B as a toner supplying portion, and an area C as a toner collecting portion. The toner in the developer container 3 is normally circulated in the direction of area A→B→C→A.

Figure 6:
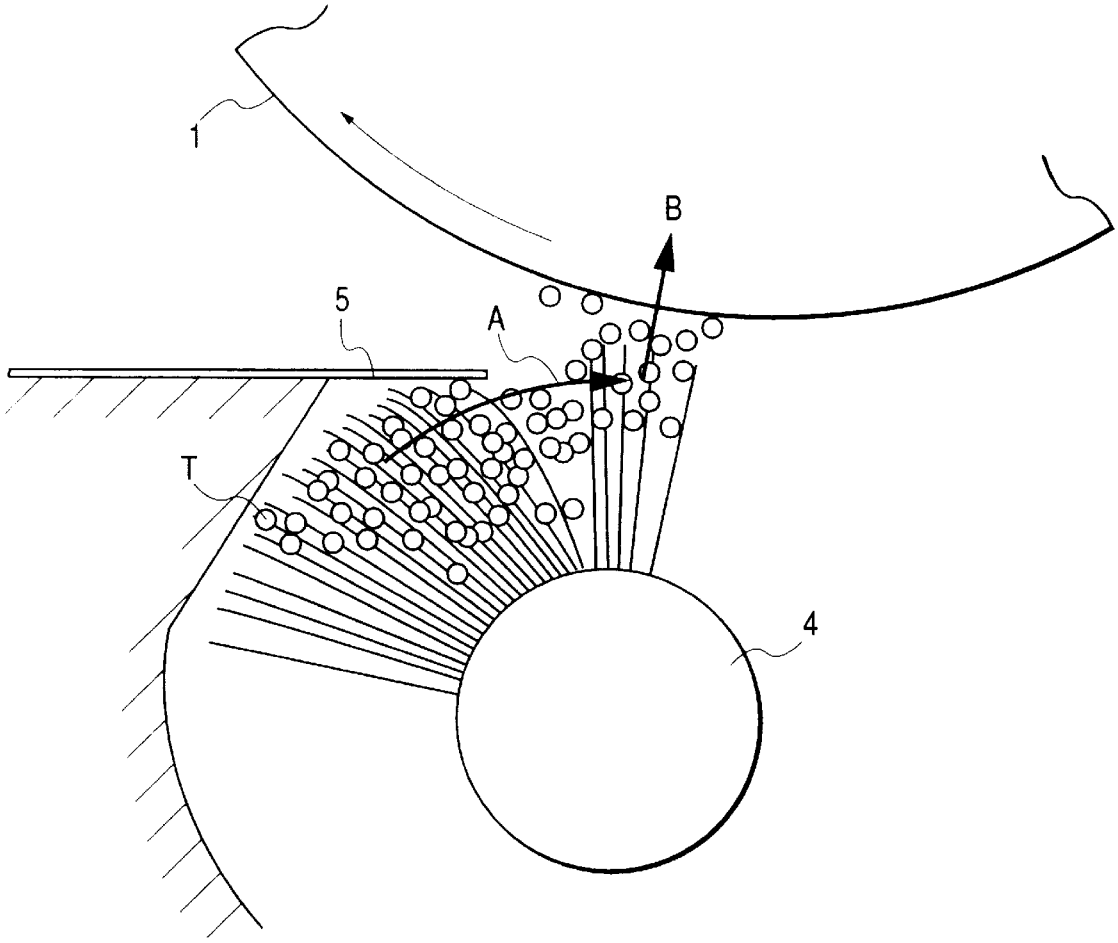
FIG. 6 is an illustration showing a method of supplying the toner to a developing roller by the toner supplying brush in the developing device of FIG. 2.

The toner contained in the toner containing portion A passes through a communication port 12*a* in the lower portion of the partition member 12, by the carried by the agitating member 10, and is sent to the toner supplying brush 4 of the toner supplying portion B. The toner sent to the toner supplying brush 4 adheres to between the fibers of the brush 4 and the surfaces of the fibers by a reflection force or the like, and is carried toward the toner flow path control member 5 with the rotation of the brush 4, and contacts with the toner flow path control member 5, whereby charges are stably imparted to the toner. Then, as shown in FIG. 6, the toner T passes the toner flow path control member 5, and thereafter springs out in the direction of rotation of the brush 4 by the resilent force when the fibers of the toner supplying brush 4 come off the flow path control member 5, and assumes a cloud-like state and flies in the direction of arrow A.

The toner supplying brush 4 is brought into contact with the toner flow path control member 5 so as to spring out the toner in the brush 4 and therefore, any uncharged toner, reversal toner etc. residual among the fibers of the brush can also be discharged, and the clogging of the fibers by these toners can also be prevented.

Between the toner supplying brush 4 and the developing roller 1, there is formed an electric field by the developing bias applied to the developing roller 1 and the bias applied to the toner supplying brush 4 by the power source 6, and the cloud-like toner flying in the direction of arrow A is attracted to the developing roller 1 as indicated by arrow B by this electric field, and is borne on the surface of the developing roller 1.

Figure 7A:
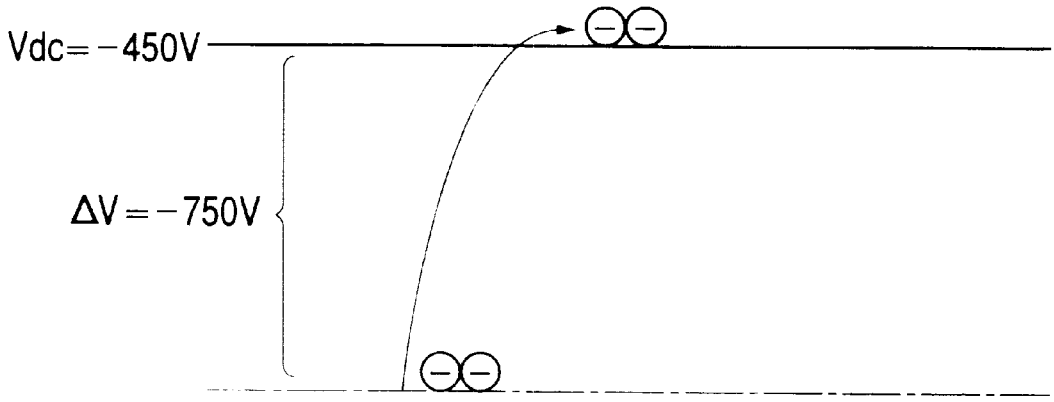
FIGS. 7A and 7B are illustrations showing examples of the construction of a bias used for toner supply and development in the image forming apparatus of FIG. 1.

When as shown, for example, in FIG. 7A, the DC component of the developing bias is set to Vdc=−450 V, if setting is made so that by the power source 6, a bias comprising a DC voltage of the order of ΔV=−750 V superimposed on the developing bias may be applied to the toner supplying brush 4, the toner charged to the negative polarity is attracted from the toner supplying brush 4 to the developing roller I by the action of the electric field by the difference in the DC voltage.

The toner supplied onto the developing roller 1 in this manner is borne on the developing roller 1 by the reflection force, and thereafter is carried to the regulating blade 7, and has its toner layer thickness adjusted by the regulation by the blade 7, and has further triboelectric charges imparted thereto and is formed into a fine toner layer having a uniform charging amount distribution.

As described above, the charged toner is once made into a cloud-like state, and the toner is supplied onto the developing roller 1 in the non-contact fashion by the electric field and therefore, mechanical stress to the toner can be remarkably reduced, and only the sufficiently charged toner can be supplied onto the developing roller 1 to thereby form a very sharp toner layer having little inclination of the charging amount distribution.

Figure 7B:
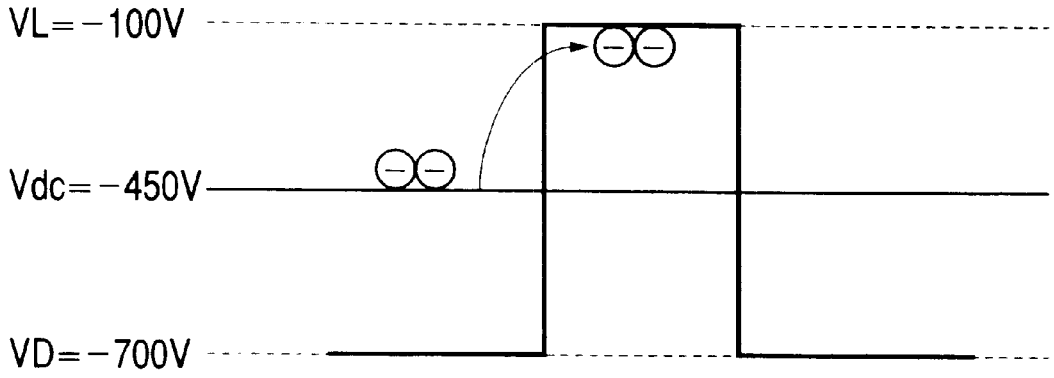

The toner layered on the developing roller 1 adheres to an exposed portion in the opposed portion to the photosensitive drum 11 on which an electrostatic latent image is formed by the uniform charging of VD=about −700V by the charging device 16 and the image exposure by the exposing device 15, by the electric field by the latent image potential (exposed portion VL=−100V and unexposed portion VD=−700V) on the photosensitive drum 11 and the developing bias Vdc=−450V applied to the developing roller 1, as shown in FIG. 7B, to thereby form a toner image conforming to the latent image on the photosensitive drum 11.

Figure 8A:
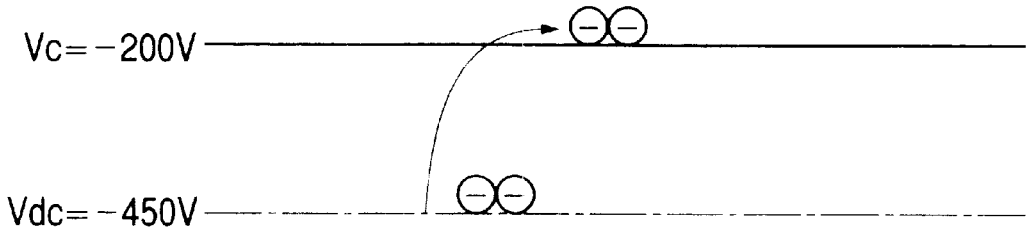
FIGS. 8A and 8B are illustrations showing examples of the construction of a bias used for the collection of the unused toner in development and the collection of the untransferred toner in the image forming apparatus of FIG. 1.

Any unused toner returned into the developer container 3 while being borne on the developing roller 1 without contributing to development electrostatically adheres to and is collected on the surface of the toner collecting roller 8 by an electric field formed by a DC bias Vc=about −200V applied to the toner collecting roller 8 and the developing bias Vdc=−450V applied to the developing roller 1, as shown in FIG. 8A. The collected toner is carried into the developing device 3 with the rotation of the toner collecting roller 8, is scraped off by the scraper 9 and is contained in the toner containing portion A.

If the collecting roller 8 and the scraper 9 are used as described above, the surface of the collecting roller 8 can always be maintained as a fresh electrode surface relative to the developing roller 1, and a stable electric field can always be formed between the collecting roller 8 and the developing roller 1.

Figure 5:
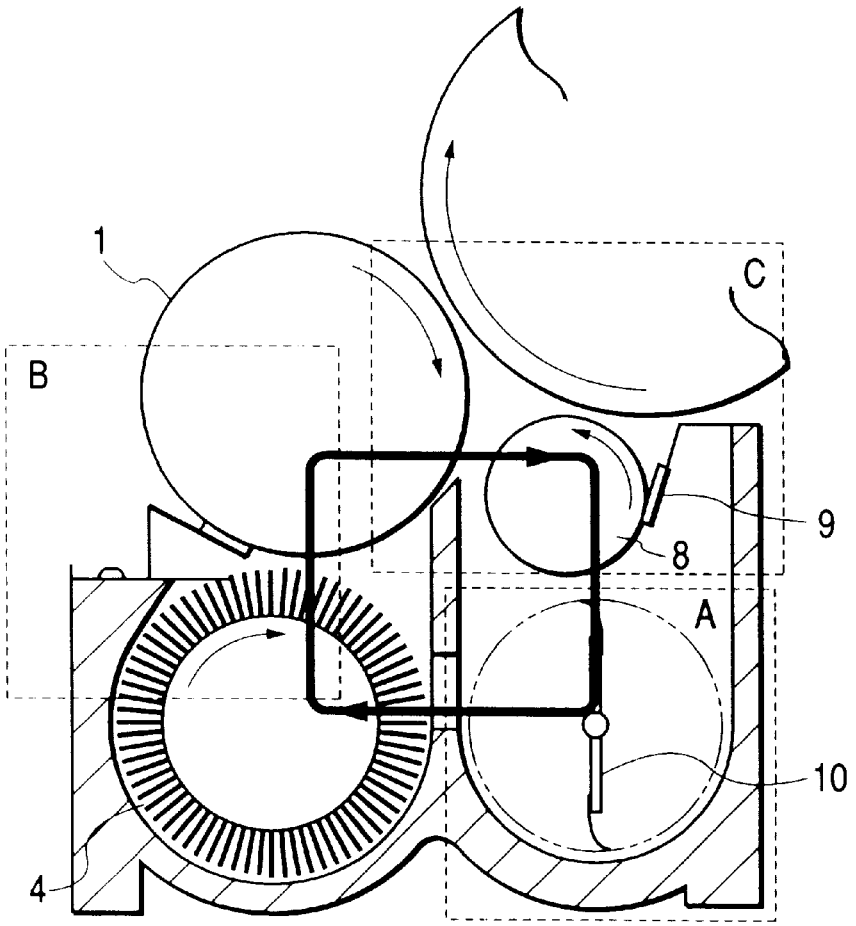
FIG. 5 is a conceptional view showing the direction of circulation of a toner in the developing device of FIG. 2.

In the manner described above, the unused toner in development is completely separated from the developing roller 1 and is reliably collected in the toner containing portion A, whereby the circulation path of the toner in the direction of the area A→B→C→A of FIG. 5 can be made in the developer container 3, and without a continuous load being given to the toner, the heating of the toner itself can be prevented to thereby minimize the deterioration of the toner. As the result, the life of the toner is markedly extended and good image formation can be effected for a long period of time.

The toner image formed on the photosensitive drum 11 is carried toward the transfer roller 13, and is transferred onto the transfer material P by a transfer bias applied to the transfer roller 13 in a transfer portion (the opposed portion to the transfer roller 13), and then the transferred toner image is fixed on the transfer material P in the fixing device 14. Any untransferred toner residual on the photosensitive drum 11 without being transferred to the transfer material P in the transfer portion advances again to the next charging and exposing steps while being borne on the photosensitive drum 11.

The untransferred toner often contains uncharged toner and reversal polarity toner contained from the time of development, or uncharged toner and reversal polarity toner having their charging polarity changed by the injection of charges or discharge during transfer. When the photosensitive drum 11 bearing these untransferred toners thereon is again charged to VD=−700V by the charging device 16, the untransferred toners on the photosensitive drum 11 are uniformly re-charged to the desired negative polarity at the same time.

Figure 8B:
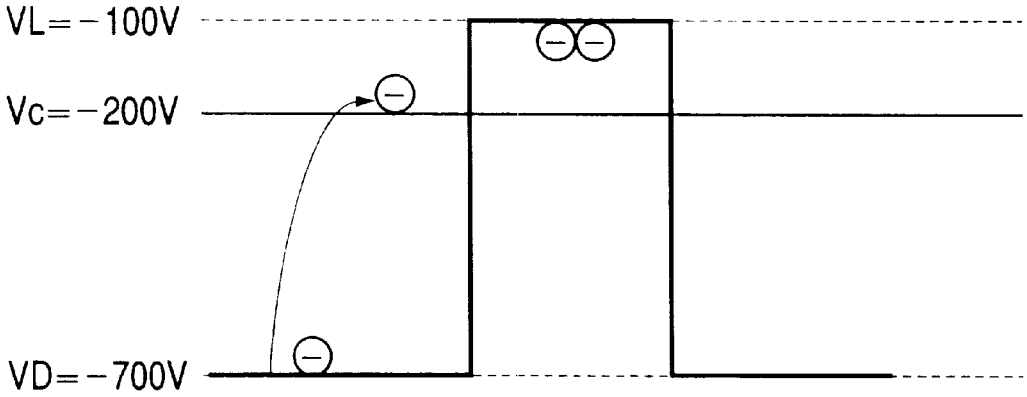
Figure 9:
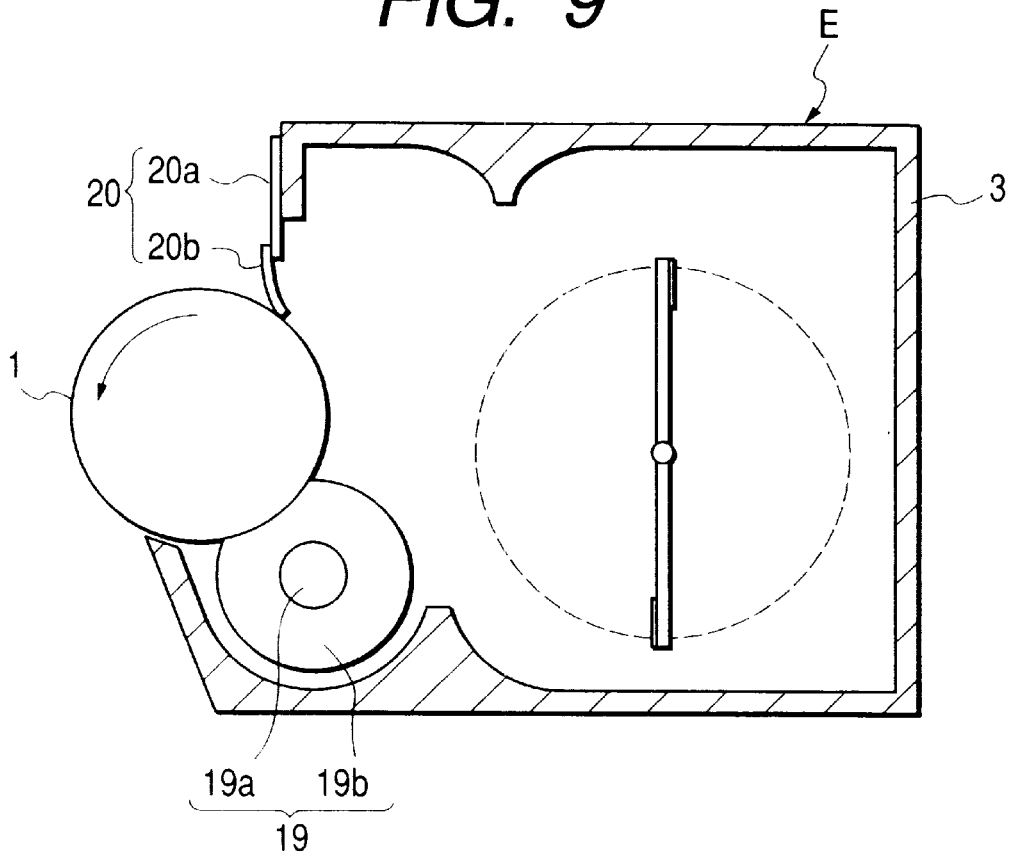
FIG. 9 is a schematic cross-sectional view showing a developing device installed in a related image forming apparatus.
Figure 10:
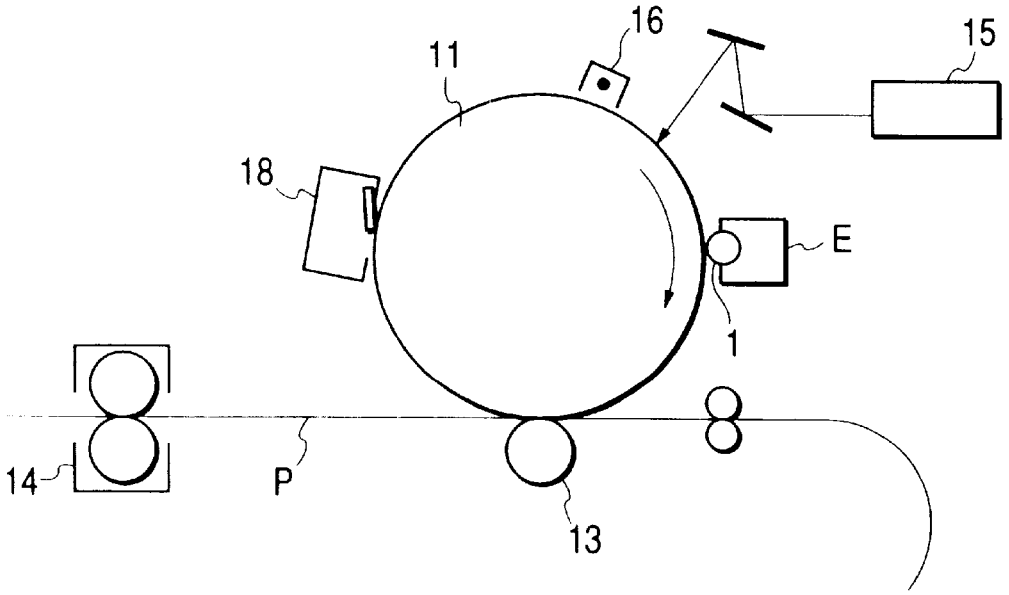
FIG. 10 is a schematic view showing the related image forming apparatus.

On the photosensitive drum 11, a new electrostatic latent image is formed by the exposing device 15, and the electrostatic latent image is carried to the opposed portion to the toner collecting roller 8 while bearing the untransferred toner on the surface thereof. As shown in FIG. 8B, a DC bias of Vc=about −200V is applied to the toner collecting roller 8 and therefore, relative to the potential of the non-image portion (unexposed portion) (VD=−700V) of the new electrostatic latent image, there is formed an electric field by which the untransferred toner on the photosensitive drum 11 is attracted to the collecting roller 8 side. On the other hand, relative to the potential of the image portion (exposed portion) (VL=−100V) of the new electrostatic latent image, there is formed such an electric field that the untransferred toner is restrained on the photosensitive drum 11 side. Accordingly, only the untransferred toner present on the non-image portion of the new latent image is collected by the toner collecting roller 8, and the untransferred toner present on the image portion of the new latent image is introduced to the next developing step while being borne on the photosensitive drum 11, and is used for development.

As described above, according to the present embodiment, the toner is taken into the toner supplying brush disposed in contact with one end of the toner flow path control member, and by the resilient force when by the rotation of the supplying brush, the supplying brush comes off the toner flow path control member, the toner is sprung out from the supplying brush and assumes a cloud-like state and also, by the electric field formed between the developing roller and the supplying brush, only the toner of the cloud-like toner which has a desired charging amount is supplied onto the developing roller. Accordingly, there is no supply of the toner by the contact with and the frictional sliding with the developing roller as is experienced in the case of the conventional toner supplying roller disposed-in contact with the developing roller and therefore, the stress to the toner resulting from the supply of the toner to the developing roller can be markedly reduced. Also, the toner having a proper charging amount is selectively supplied out of the cloud-like toner and therefore, not only the uncharged toner or the reversal toner is made difficult to supply, but also the imparting of charges to the toner by the regulating blade may be little and as the result, the contact pressure of the regulating blade can be reduced and the load to the toner can be made reduced.

Also, the unused toner in development returned to the developer container without contributing to development is electrostatically stripped by the toner collecting roller disposed in non-contact with the developing roller and is reliably returned to the toner containing portion, whereby the circulation path of the toner is formed in the developer container and therefore, the unused toner in development repetitively passes through the nip portion of the regulating blade, and a continuous load can be prevented from being applied to the toner and therefore, the embedding of an extraneous additive into the toner by heat accumulation or the like can be remarkably suppressed and the deterioration of the toner can be prevented.

Further, the toner collecting roller can also collect the untransferred toner on the photosensitive drum in the opposed portion to the photosensitive drum and therefore, a cleaning mechanism as in the prior art can be eliminated for the photosensitive drum, and the downsizing and lower cost of the entire image forming apparatus become possible.

Accordingly, according to the present embodiment, the load to the toner can be remarkably reduced and images of high clarity free of fog or the like can be obtained for a long period of time, and the downsizing and lower cost of the entire apparatus become possible.

Embodiment 2

Figure 11:
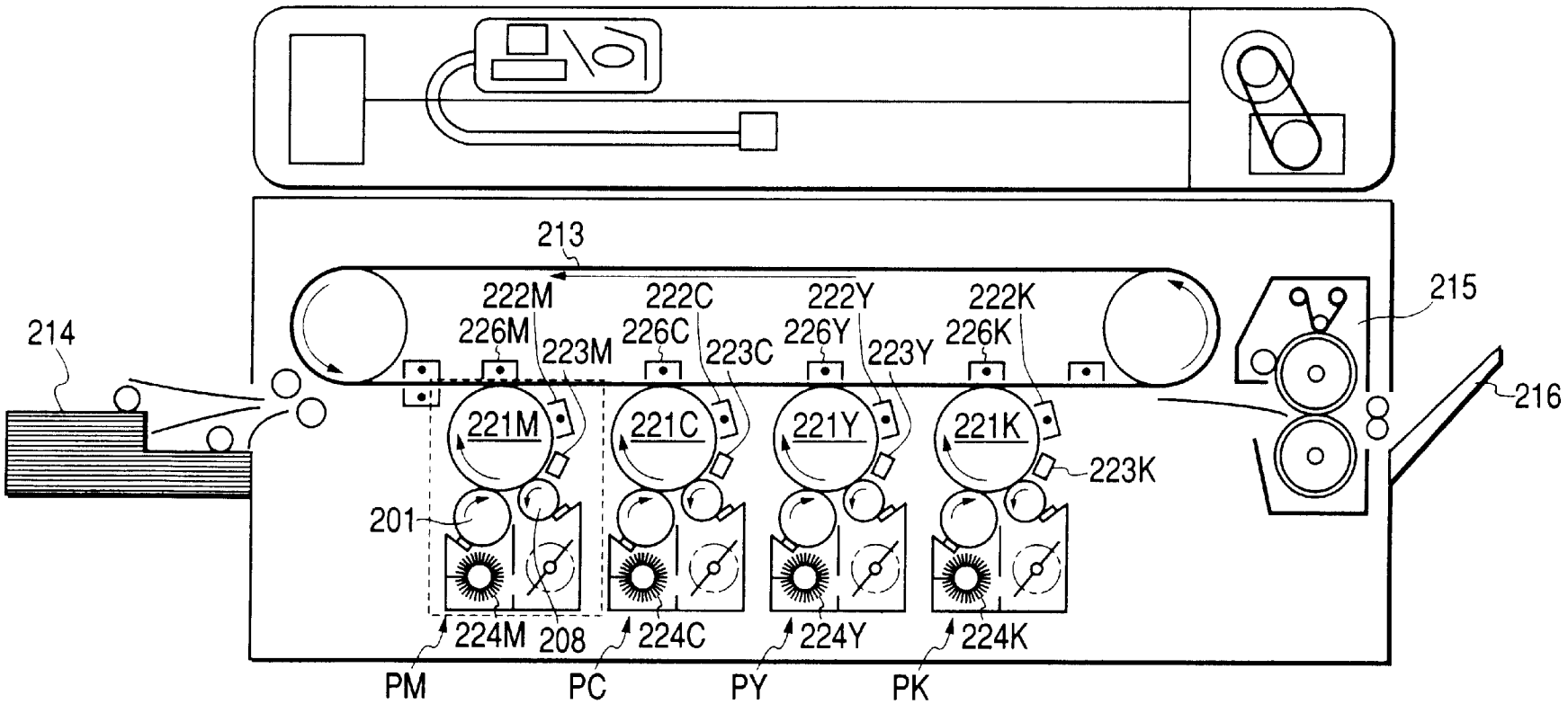
FIG. 11 schematically shows the construction of another embodiment of the image forming apparatus of the present invention.

FIG. 11 schematically shows the construction of an embodiment of the image forming apparatus of the present invention.

The color image forming apparatus of the present embodiment shown in FIG. 11 is provided with first, second, third and fourth image forming portions PM, PC, PY and PK, and a sheet feeding portion 214 and a fixing device 215 are disposed on the left side and the right side, respectively, of the apparatus as viewed in FIG. 11. Also, endless transfer material conveying means (a transfer material conveying belt) 213 for conveying the transfer material is passed over a plurality of rollers above a path in the main body of the apparatus leading from the sheet feeding portion 214 to the fixing device 215. This conveying belt 213 is rotatively driven in the direction of the arrow, and bears thereon the transfer material fed through the sheet feeding portion 214 and conveys it to the image forming portions PM, PC, PY and PK disposed below the conveying belt 213.

The image forming portions PM, PC, PY and PK are substantially the same in construction and usually include photosensitive drums 221M, 221C, 221Y and 221K which are image bearing members rotatively driven in the direction of arrow. Primary chargers 222M, 222C, 222Y, 222K for uniformly charging the photosensitive drums, image exposing devices 223 (223M, 223C, 223Y, 223K) for forming electrostatic latent images on the photosensitive drums, developing devices 224 (224M, 224C, 224Y, 224K) for developing the electrostatic latent images formed on the photosensitive drums, and corona chargers 226 (226M 226C, 226Y, 226K) for transferring toner images which are visible images obtained by the development to the transfer material are disposed in succession around the photosensitive drums 221 (221M, 221C, 221Y, 221K) in the direction of rotation of the drums.

In the present embodiment, the image forming apparatus is cleanerless and there is installed no drum cleaner for removing untransferred toners residual on the photosensitive drums.

A magenta toner, a cyan toner, a yellow toner and a black toner are contained in the developing devices 224M, 224C, 224Y and 224K, respectively.

In the present embodiment, the image exposing devices 223 (223M to 223K) are LED heads comprising LED light-emitting elements arranged in the direction of the generatrix of the photosensitive drums, and are adapted to expose the surfaces of the photosensitive drums 221 (221M to 221K) corresponding to desired image signals to thereby form electrostatic latent images of corresponding colors. That is, a pixel signal corresponding to the magenta component image of a color image is inputted to the image exposing device 223M, a pixel signal corresponding to the cyan component image of the color image is inputted to the image exposing device 223C, a pixel signal corresponding to the yellow component image of the color image is inputted to the image exposing device 223Y, and a pixel signal corresponding to the black component image of the color image is inputted to the image exposing device 223K.

Between the first image forming portion PM and the sheet feeding portion 214, a pair of adsorbing chargers (not shown) for adsorbing the transfer material are disposed in opposed relationship with each other with the conveying belt 213 interposed therebetween. Between the fourth image forming portion PK and the fixing device 215, a charge removing charger (not shown) for separating the transfer material adsorbed to the conveying belt 213 is installed, and during the separation, an AC voltage is applied from a voltage source (not shown) to the charge removing charger.

The image forming process and the cleaning mechanism in the above-described image forming apparatus will now be described briefly. The image forming portions PM to PK are basically the same.

In the first image forming portion PM, the photosensitive drum 221M is rotated in the direction of the arrow, and in the process of rotation thereof, the surface of the photosensitive drum is uniformly charged to a desired polarity and potential by the charger 222M, and then is subjected to image exposure conforming to desired image data by the image exposing device 223M to thereby form an electrostatic latent image on the surface of the photosensitive drum. Next, in a developing portion wherein the photosensitive drum 221M and the developing roller 201 of the developing device 24M are opposed to each other, the electrostatic latent image on the photosensitive drum is developed by the non-magnetic toner on the developing roller 201 to thereby form a magenta toner image conforming to the electrostatic latent image on the photosensitive drum.

The magenta toner image formed on the photosensitive drum 221M is transferred to the transfer material conveyed to a transfer portion in which the photosensitive drum and the transfer charger (corona charger) 226M are opposed to each other with a transfer bias applied to the transfer charger 226M.

The transfer material to which the magenta toner image has been transferred in this manner is conveyed to the next image forming portion PC, in which a yellow toner image formed on the photosensitive drum 221C by an image forming process similar to that in the image forming portion PM is transferred to the transfer material while being superposed on the magenta toner image. Likewise, the transfer material is conveyed to the third and fourth image forming portions PY and PK in succession, where the same process is repeated, whereby a full color image comprising toner images of four colors superposed one upon another is formed on the transfer material. This transfer material is introduced into the fixing device 214, and the toner images are heated and fixed on the transfer material, whereby a full color image is obtained on the transfer material, thus completing a series of image forming steps.

On the other hand, the unused toners on the developing rollers 201 of the developing devices 224 (224M to 224K) which have not contributed to development during the above-described development are caused to adhere to and collected on the toner collecting rollers 208 of the developing devices 224 by an electric field formed by a developing bias applied to the developing rollers 201 and a collecting bias applied to the toner collecting rollers 208, and are returned into the developing devices 224.

Also, the untransferred toners remaining on the photosensitive drums 221 (221M to 221K) not having been transferred to the transfer material during the above-described transfer, advance again to the charging and exposing steps while being borne on the photosensitive drums 221, and thereafter are caused to adhere to and collect on the toner collecting rollers 208 in the opposed portion to the toner collecting rollers 208 by an electric field formed by the potential made by the electrostatic latent images newly formed on the photosensitive drums 221 and the bias applied to the toner collecting rollers 208, and are returned into the developing devices 224.

As described above, according to the present embodiment, of the untransferred toners on the photosensitive drums 221, only the untransferred toners present on the non-image portions (non-exposed portions) of the new electrostatic latent images are removed and are collected to the toner collecting roller 208 side. The remaining untransferred toners present on the image portions (exposed portions) of the new electrostatic latent images will soon be used for development at the next developing step and therefore, there is no influence even if they are introduced into the developing step while being borne on the photosensitive drums 221.

Thereafter, similar developing, transferring and fixing steps are effected on the new electrostatic latent images, and such image formation is repeated.

The developing devices used in the present embodiment and a cleanerless mechanism using these developing devices will hereinafter be described in detail. The developing devices 224M to 224K are basically the same.

Figure 12:
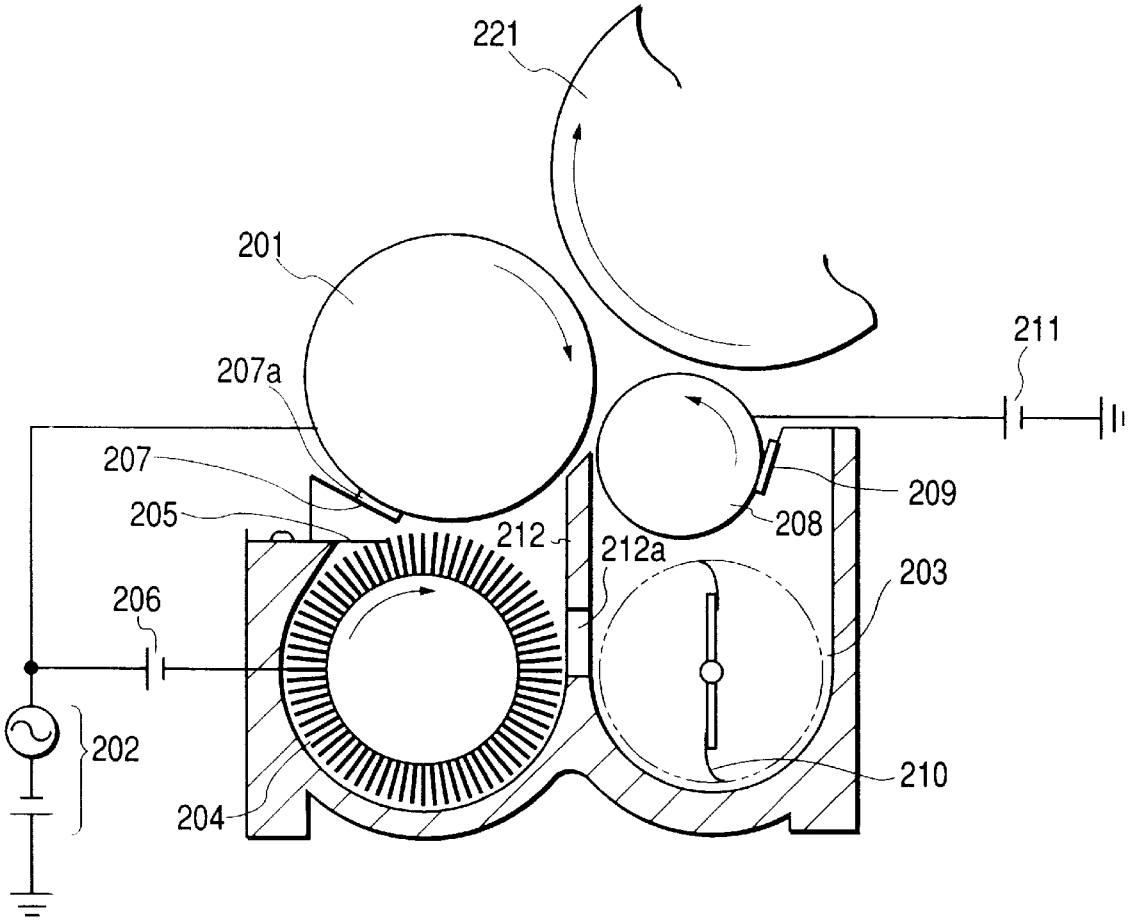
FIG. 12 is a cross-sectional view showing a developing device in the image forming apparatus of FIG. 11.

As shown in FIG. 12, in the present embodiment, each of the developing devices 224 (224M to 224K) has a developer container 203 containing a non-magnetic toner (non-magnetic monocomponent developer) therein, and in the developer container 203, there are provided a developing roller 201, a toner supplying brush 204, a toner flow path control member 205, a toner regulating blade 207, the aforedescribed toner collecting roller 208, a toner stripping scraper 209 and a toner agitating member 210. The interior of the developer container 203 is partitioned by a partition member 212 extending to this side of an opening portion, and a communication port 212*a* is provided in the lower portion of the partition member 212.

The developing roller 201 is provided in the opening portion of the developer container 203 in opposed relationship with the photosensitive drum 221 with a predetermined interval therebetween, and is rotatively driven in the direction of the arrow. In the present embodiment, a metallic roller made of SUS, aluminum or the like is used as the developing roller 201. A power source 202 for applying a predetermined developing bias is connected to the developing roller 201.

In the present embodiment, an AC+DC bias of which the peak-to-peak voltage Vpp is about 2 kV, the frequency f is about 1.8 kHz and the CD offset value Vdc is −450V is set in the developing bias voltage source 202.

The toner supplying brush 204 is for taking the non-magnetic toner in the developer container 203 thereinto and supplying it to the developing roller 201, and is disposed for rotation in the same direction (the opposite direction in the most proximate portion) as the direction of rotation of the developing roller 201 with an interval of 100 $\mu$m to 1 mm between itself and the developing roller 201. A voltage comprising a desired DC voltage Vf superimposed on a developing bias is applied to the mandrel of the toner supplying brush 204 by a voltage source 206, whereby a desired electric field is formed between itself and the developing roller 201. In the other points, unless otherwise specified, the construction of the developing devices is similar to that of Embodiment 1.

Figure 13A:
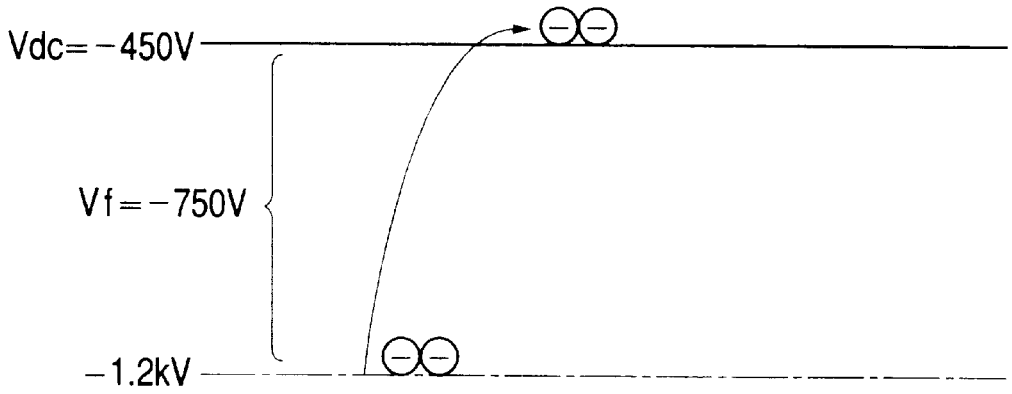
FIGS. 13A and 13B are illustrations showing examples of the construction of a bias used for toner supply and development in the image forming apparatus of FIG. 11.

In the present embodiment, when as shown, for example, in FIG. 13A, the DC component of the developing bias is set as Vdc=−450V, if setting is effected so that a bias comprising a DC voltage of which Vf=−750V superimposed on the developing bias, i.e., an AC+DC bias (in FIG. 13A, the AC component is omitted) in which Vpp and Vf are the same as the developing bias and the DC component is −1.2 kV (Vdc+Vf), such bias may be applied to the toner supplying brush 4 by the voltage source 206, the toner charged to the negative polarity is thereby attracted from the toner supplying brush 204 to the developing roller 201 by the action of the electric field by the difference (−750V) in the DC voltage.

The toner supplied onto the developing roller 201 in this manner is borne on the developing roller 201 by a reflection force, whereafter it is carried to the regulating blade 207, and has its toner layer thickness adjusted by the regulation by the blade 207 and is subjected to the further imparting of triboelectric charges, and is formed into a fine toner layer having a uniform charging amount distribution.

As described above, the charged toner is once made into a cloud-like state and is supplied onto the developing roller 201 in non-contact by the electric field and therefore, mechanical stress to the toner can be remarkably reduced and only the sufficiently charged toner can be supplied onto the developing roller 201, and a very sharp toner layer having little inclination of the charging amount distribution can be formed.

Figure 13B:
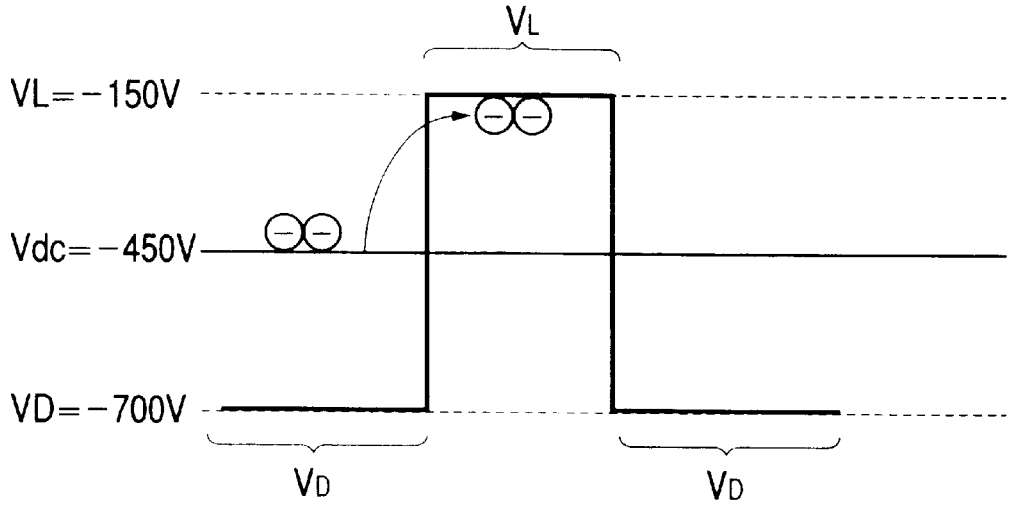

The toner formed into a toner layer on the developing roller 201 adheres to the exposed portion by an electric field formed by the latent image potential (exposed portion VL=−100V and unexposed portion VD=−700V) and the developing bias (Vpp=about 2 kV, f=about 1.8 kHz and Vdc=−450V) (in the figure, the AC component is omitted) applied to the developing roller 201, as shown in FIG. 13B, in the opposed portion to the photosensitive drum 221 on which the electrostatic latent image has been formed by the uniform charging of VD=about −700 V by the charger 202 and the image exposure by the image exposing device 223, and forms a toner image conforming to the latent image on the photosensitive drum 221.

Figure 14A:
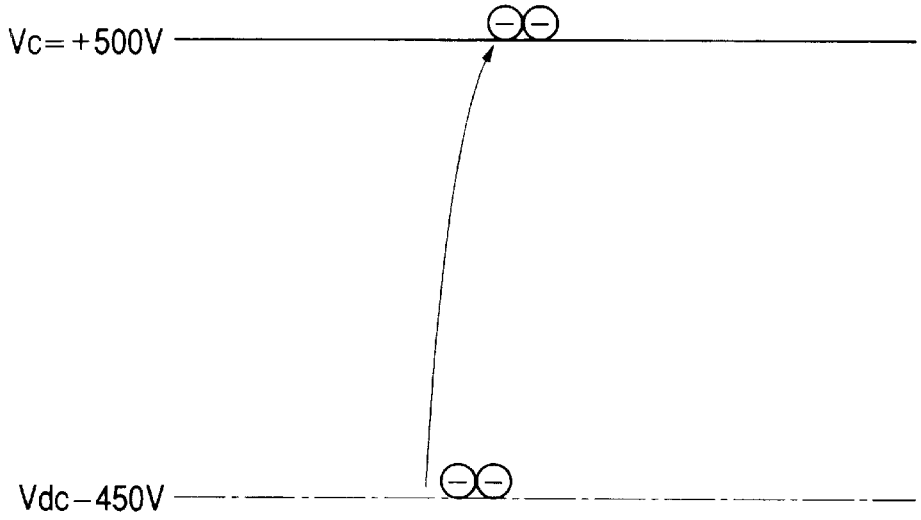
FIGS. 14A and 14B are illustrations showing examples of a bias used for the collection of the unused toner in development and the collection of the untransferred toner in the image forming apparatus of FIG. 11.

The unused toner in development returned into the developer container 203 while being borne on the developing roller 221 without contributing to development electrostatically adheres to and is collected on the surface of the toner collecting roller 208 by an AC+DC electric field formed by a DC bias VC=+500V applied to the toner collecting roller 208 and a developing bias (Vpp=about 2 kV, f=about 1.8 kHz and Vdc=−450V) (in the figure, the AC component is omitted) applied to the developing roller 201, as shown in FIG. 14A. The collected toner is carried into the developing device 203 with the rotation of the toner collecting roller 208, is scraped off by the scraper 209 and is contained in the toner containing portion A.

If as described above, the scraper 209 is used for the toner collecting roller 208, the surface of the collecting roller 208 can always be maintained as a fresh electrode surface for the developing roller 201, and a stable electric field can always be formed between the collecting roller 208 and the developing roller 201.

In the manner described above, the unused toner in development is completely separated from the developing roller 201 and is reliably contained in the toner containing portion A, whereby as previously described, the circulation path of the toner can be made in the developer container 203, and without a continuous load being given to the toner, the heating of the toner itself can be prevented to thereby minimize the deterioration of the toner. As the result, the life of the toner extends markedly and good image formation can be effected for a long period of time.

The toner image formed on the photosensitive drum 221 is carried toward the transfer charger 226, and in the transfer portion (the opposed portion to the transfer charger 226), it is transferred onto the transfer material by a transfer bias applied to the transfer charger 226, and then the transferred toner image is fixed on the transfer material in the fixing device 214. The untransferred toner remaining on the photosensitive drum 221M without being transferred to the transfer material in the transfer portion advances again to the charging and exposing steps while being borne on the photosensitive drum 221.

The untransferred toner often contains uncharged toner and reversal polarity toner contained from the time of development, or uncharged toner and reversal polarity toner changed in charging polarity by charge injection or discharge during transfer. When the photosensitive drum 221 bearing these untransferred toners thereon is again charged to VD=−700V by the charger 202, the untransferred toners on the photosensitive drum 221 are also uniformly re-charged to a desired polarity at the same time.

Figure 14B:
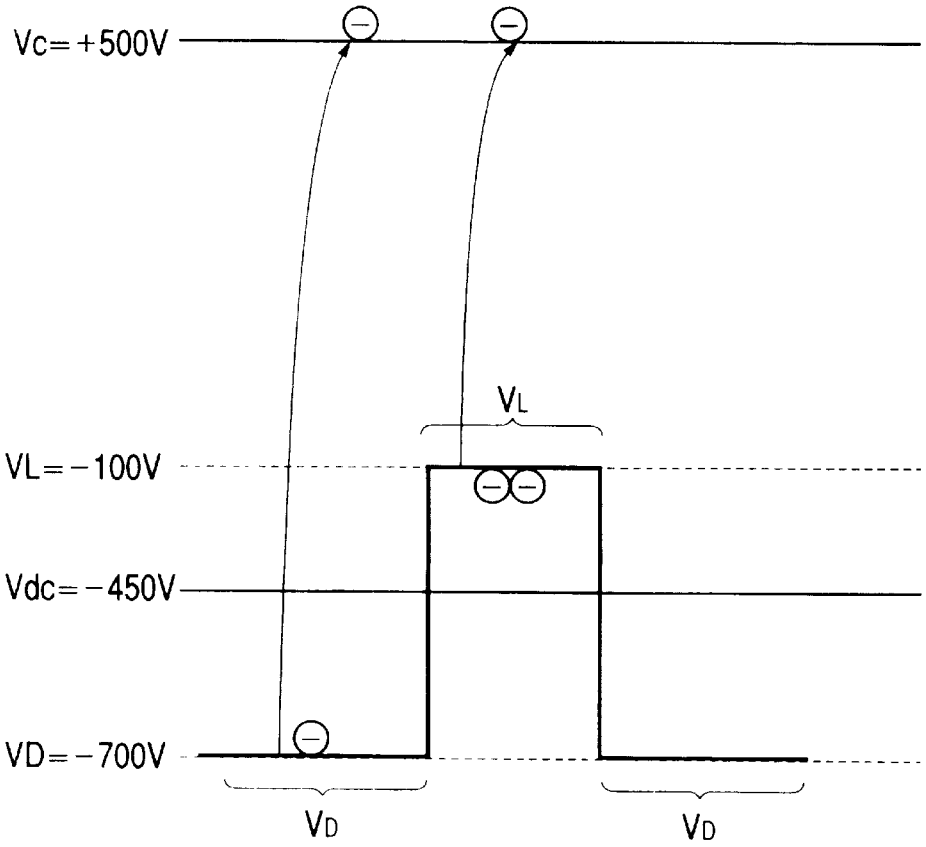

A new electrostatic latent image is formed on the photosensitive drum 221 by the image exposing device 223, and the electrostatic latent image is carried to the opposed portion to the toner collecting roller 208 while bearing the untransferred toner on the surface thereof. As shown in FIG. 14B, a DC bias of Vc=+500V is applied to the toner collecting roller 208 and therefore, because of the potential of the non-image portion (unexposed portion (VD=−700V) of the new electrostatic latent image, there is formed an electric field by which the untransferred toner on the photosensitive drum 221 is attracted to the collecting roller 208 side. On the other hand, also because of the potential of the image portion (exposed portion) (VL=−100V) of the new electrostatic latent image, there is formed an electric field which attracts the untransferred toner remaining on that portion to the collecting roller 208. However, the collection contrast thereof is small as compared with that of the non-image portion (VD=−700V) and therefore, some toner may intactly remain, but it is on the image portion and thus, the collection of such toner is not necessary.

The voltage Vc applied to the toner collecting roller 208 is not limited to the value described in the present embodiment, but is suitably changed and set depending on the interval between the developing roller 201 and the photosensitive drum 203 (203M to 203K) and the charging amount of the toner or the like, and in same cases, a DC+AC bias is also applied.

Embodiment 3

Figure 15:
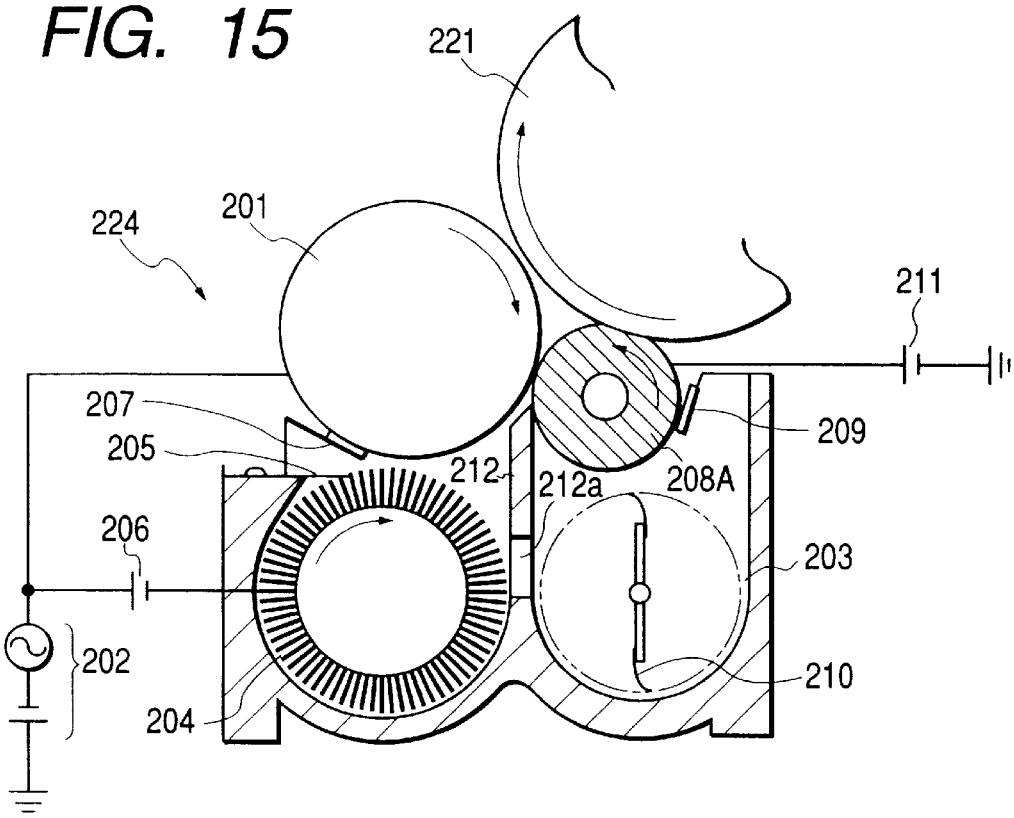
FIG. 15 is a cross-sectional view showing a developing device in still another embodiment of the present invention.

FIG. 15 is a cross-sectional view showing a developing device in another embodiment of the present invention.

In Embodiments 1 and 2, as shown in FIGS. 2 and 12, the toner collecting roller 208 of the developing device 224 which comprises a metallic roller is used in non-contact with the photosensitive drum 221 and the developing roller 201 to collect the untransferred toner on the photosensitive drum 221 and the unused toner in development on the developing roller 201.

In the present embodiment, as shown in FIG. 15, a toner collecting roller 208A comprising an elastic roller is used in a developing device 224, and in order to carry out the collection of the untransferred toner in a contact fashion, the toner collecting roller 208A is used in contact with a photosensitive drum 221. As in Embodiments 1 and 2, the toner collecting roller 208A is used in non-contact with a developing roller 201. In the other points, the construction of the present embodiment is basically the same as that of Embodiment 2, and in FIG. 15, the same reference numerals as the reference numerals used in FIG. 12 designate the same members.

The toner collecting roller 208A in the present embodiment comprises an elastic roller having one or more elastic layers on a mandrel, and as the material of the elastic layer or layers, use can be made of an ordinary rubber material such as silicone rubber, NBR rubber, EPDM rubber or urethane rubber. The surface of the elastic layer or layers may be as it is, but can also be covered with electrically conductive resin comprising carbon or the like dispersed in resin such as nylon. The rubber hardness of the elastic layer or layers, including the electrically conductive resin film on the surface thereof, is suitably of the order of 20 to 70° as measured by a JISA rubber hardness meter. Also, the surface of the elastic layer or layers may desirably have surface roughness Rz of 10 or less with the parting property of the toner taken into account, and can be set in accordance with the particle diameter and shape of the toner used. The resistance value of the toner collecting roller 208A, including the electrically conductive resin film, may preferably be set to volume resistivity of the order of $10^3$ to $10^9$ Ωcm.

When the toner collecting roller 208A of the contact type with the photosensitive drum 221 is used as in the present embodiment, the voltage applied to the collecting roller 208A may be small as compared with the case of a toner collecting roller of a non-contact type and therefore, the voltage applied to the collecting roller 208A by a voltage source 211 is V=+200V or so.

The untransferred toner on the photosensitive drum 221 (the toner on the unexposed portion) adheres from the photo-sensitive drum 221 to the toner collecting roller 208A in contact therewith by the action of a DC electric field formed by an electrostatic latent image (exposed portion potential VL=−100V and unexposed portion potential VD=−700V) and a bias applied to the collecting roller 208A, and is contact-collected. The untransferred toner on the photosensitive drum 221 can be sufficiently collected simply by electrically grounding the collecting roller 208A.

As described above, by adopting a construction in which the toner collecting roller 208A comprising an elastic roller is brought into contact with the photosensitive drum 221, the efficiency of collecting the untransferred toner on the photosensitive drum 221 is improved.

On the other hand, the unused toner in development on the developing roller 201 shifts and adheres from the developing roller 201 to the toner collecting roller 208A in non-contact therewith by the action of an AC+DC electric field formed by the potential difference between the developing bias (Vpp=about 2 kV, f=about 1.8 kHz, Vdc=−450V) applied to the developing roller 201 and the bias applied to the toner collecting roller 208A, and is collected in a non-contact fashion.

While in the foregoing, an elastic roller made of a rubber material is used as the toner collecting roller, the toner collecting roller may also be an elastic roller comprising a sponge-like elastic layer of low hardness of the order of 30 to 60° in terms of JISA hardness formed on a mandrel made of a metal, and an ordinary rubber-like elastic layer of silicone rubber, NBR rubber, EPDM rubber, urethane rubber or the like of hardness of 50 to 80° C. in terms of JISA hardness provided thereon, and again in this case, a sufficient effect is achieved.

Embodiment 4

Figure 16:
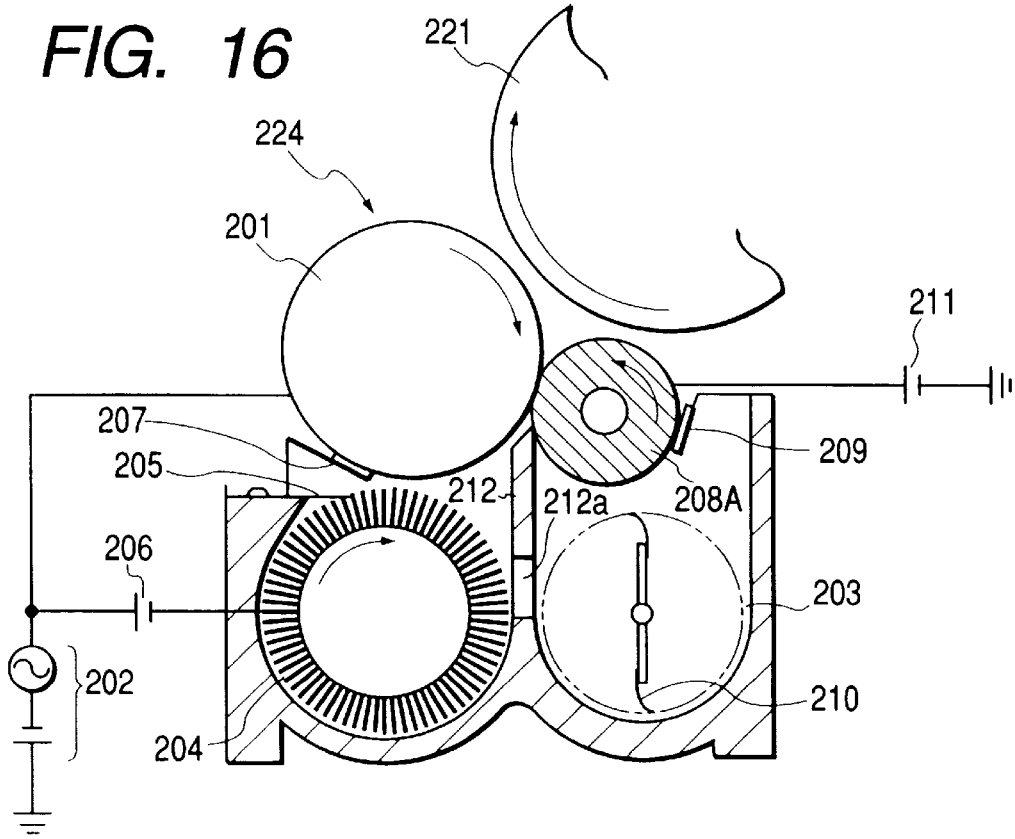
FIG. 16 is a cross-sectional view showing a developing device in yet still another embodiment of the present invention.

FIG. 16 is a cross-sectional view showing a developing device in another embodiment of the present invention.

While in Embodiment 3, the toner collecting roller 208A comprising an elastic roller made of a rubber material is used in contact with the photosensitive drum 221 and is used in non-contact with the developing roller 201 and the collection of the untransferred toner on the photosensitive drum 221 is carried out in the contact fashion and the collection of the unused toner in development on the developing roller 201 is carried out in the non-contact fashion, this is reversed in the present embodiment, as shown in FIG. 16.

That is, the toner collecting roller 208A is used in contact with the developing roller 201 and is used in non-contact with the photosensitive drum 221, and the collection of the unused toner in development on the developing roller 201 is carried out in the contact fashion and the collection of the untransferred toner on the photosensitive drum 221 is carried out in the non-contact fashion.

In the present embodiment, a bias comprising a desired DC voltage Vc superimposed on a developing bias is applied to the toner collecting roller 208A by a voltage source 211, and the collection of the unused toner in development on the developing roller 201 is effected by the difference of the DC voltage from that to the developing roller 201. That is, when the DC component of the developing bias is set to Vdc=−450V, if setting is made so that a DC voltage of Vc=+45V or so may be applied from the voltage source 211 to the toner collecting roller 208A, the unused toner in development adheres from the developing roller 201 to the toner collecting roller 208A in contact therewith by the action of the electric field by the difference 450V of the DC voltage, and is contact-collected.

On the other hand, the untransferred toner on the photosensitive drum 221 shifts and adheres from the photosensitive drum 221 to the toner collecting roller 208A in contact therewith by an electric field formed between a new electrostatic latent image (exposed portion potential VL=−100V and unexposed portion potential VD=−700V) on the photosensitive drum and a bias applied to the toner collecting roller 208A (a voltage comprising a desired DC voltage Vc superimposed on the developing bias), and is collected in the non-contact fashion.

As described above, by adopting a construction in which the toner collecting roller 208A comprising an elastic roller is brought into contact with the developing roller 201, the efficiency of collecting the unused toner in development on the developing roller 201 is improved.

Embodiment 5

Figure 17:
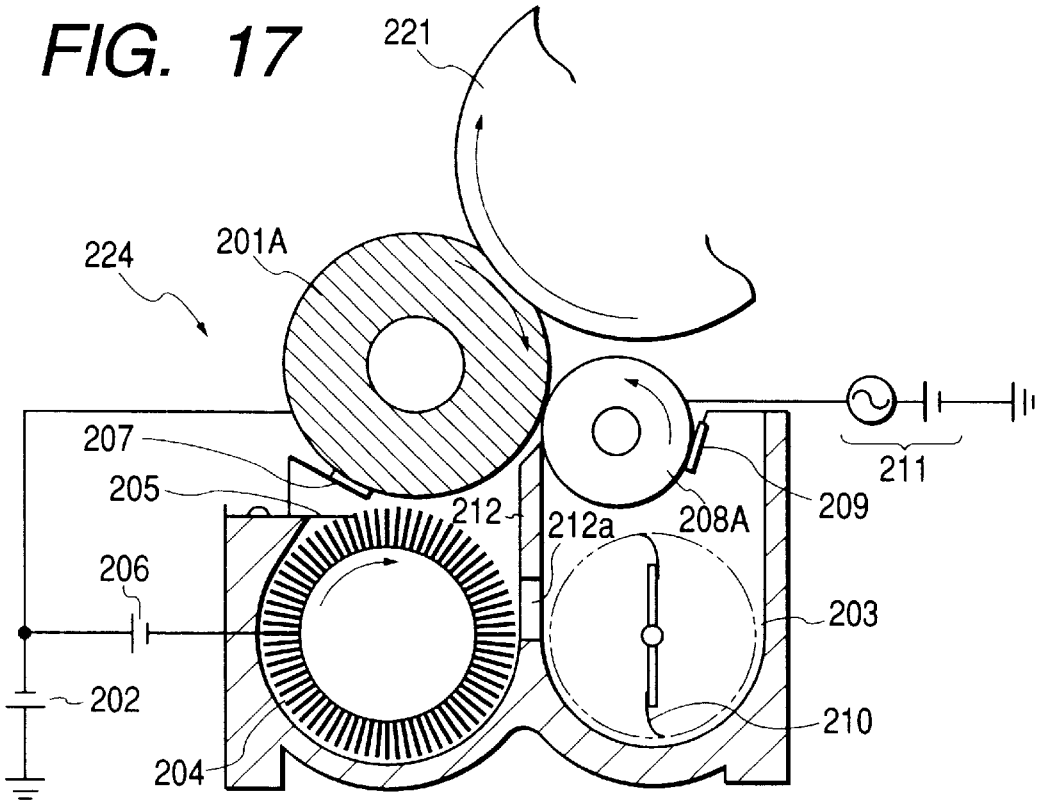
FIG. 17 is a cross-sectional view showing a developing device in a further embodiment of the present invention.

FIG. 17 is a cross-sectional view showing a developing device in still another embodiment of the present invention.

While in Embodiments 1 to 4, the developing roller 201 of the developing device 204 is made of a metal, in the present embodiment, as shown in FIG. 17, the developing roller 201A of the developing device 204 is an elastic roller and a contact developing method of bringing it into contact with the photosensitive drum 221 is adopted. Even in the case of an image forming apparatus in which the developing device 204 adopts such a contact developing method, the present invention is applicable.

In the present embodiment, the developing roller 201A is an elastic roller having one or more elastic layers on a mandrel. As the material of the elastic layer or layers, use can be made of an ordinary rubber material such as silicone rubber, NBR rubber, EPDM rubber or urethane rubber. The surface of the elastic layer or layers may be as it is, but can also be covered with electrically conductive resin comprising carbon or the like dispersed in resin such as nylon. The rubber hardness of the elastic layer or layers, including the electrically conductive resin film on the surface thereof, is suitably of the order of 20 to 70° as measured by a JISA rubber hardness meter.

Also, the surface of the elastic layer or layers may desirably have surface roughness Rz of 1 to 20 with the parting property of the toner taken into account, and can be set in accordance with the particle diameter and shape of the toner used. The resistance value of the developing roller 201A, including the electrically conductive resin film, may preferably be set to volume resistivity of the order of $10^3$ to $10^9$ Ωcm.

When the developing roller 201A is an elastic roller, the toner regulating blade 207 may preferably be a metallic thin plate having a thickness of the order of 0.1 mm. In this case, the toner regulating blade may preferably be formed into a shape in which at a position of about 2 mm from its tip end, it is bent in a direction opposite to the developing roller 201A, and the bent portion may preferably contact so as to eat into the developing roller 201A with line pressure of about 20 g/cm.

According to the present embodiment, the contact developing method is used and therefore, the developing bias applied to the developing roller 201A can sufficiently develop by only a DC voltage, and if the leak or the like with respect to the photosensitive drum is taken into account, the contact developing method by only this DC voltage (the contact DC developing method) is rather preferable in some cases.

Accordingly, in the present embodiment, for the electrostatic latent image (exposed portion potential VL=−100V and unexposed portion potential VD=−700V) on the photosensitive drum, a DC voltage of the order of −450V was applied from a voltage source 202 to the developing roller 201A to thereby effect development.

As regards the toner collecting member, as in Embodiment 1, a toner collecting roller 208 made of a metal is used, and this was used in non-contact with the developing roller 201A and the photosensitive drum 221. If in contrast with the applied voltage −450V to the developing roller 201A, an AC bias in which a DC component is 0V and f=1.8 kHz and Vpp=2 kV or so is applied to the toner collecting roller 208, the unused toner in development on the developing roller 201A can be collected in the non-contact fashion by the toner collecting roller 208.

The untransferred toner on the photo-sensitive drum 221 can also be collected onto the toner collecting roller 208 in the non-contact fashion by the action of an electric field formed by the potential of the new electrostatic latent image (exposed portion potential VL=−100V and unexposed portion potential VD=−700V) on the photosensitive drum and the applied bias to the toner collecting roller 208.

As described above, again in the case of the contact developing method in which the developing roller is brought into contact with the photosensitive drum, the collection of the unused toner in development on the developing roller and the untransferred toner on the photosensitive drum becomes possible.

While in the foregoing, the developing roller is an elastic roller made of rubber, the developing roller may also be an elastic roller comprising a sponge-like elastic layer of low-hardness of the order of 30 to 60° in terms of JISA hardness formed on a mandrel made of a metal, and an ordinary rubber-like elastic layer of silicone rubber, NBR rubber, EPDM rubber, urethane rubber or the like of high hardness of 50 to 80° in terms of JISA hardness provided thereon, and again in this case, a sufficient effect is achieved.

Embodiment 6

Figure 18:
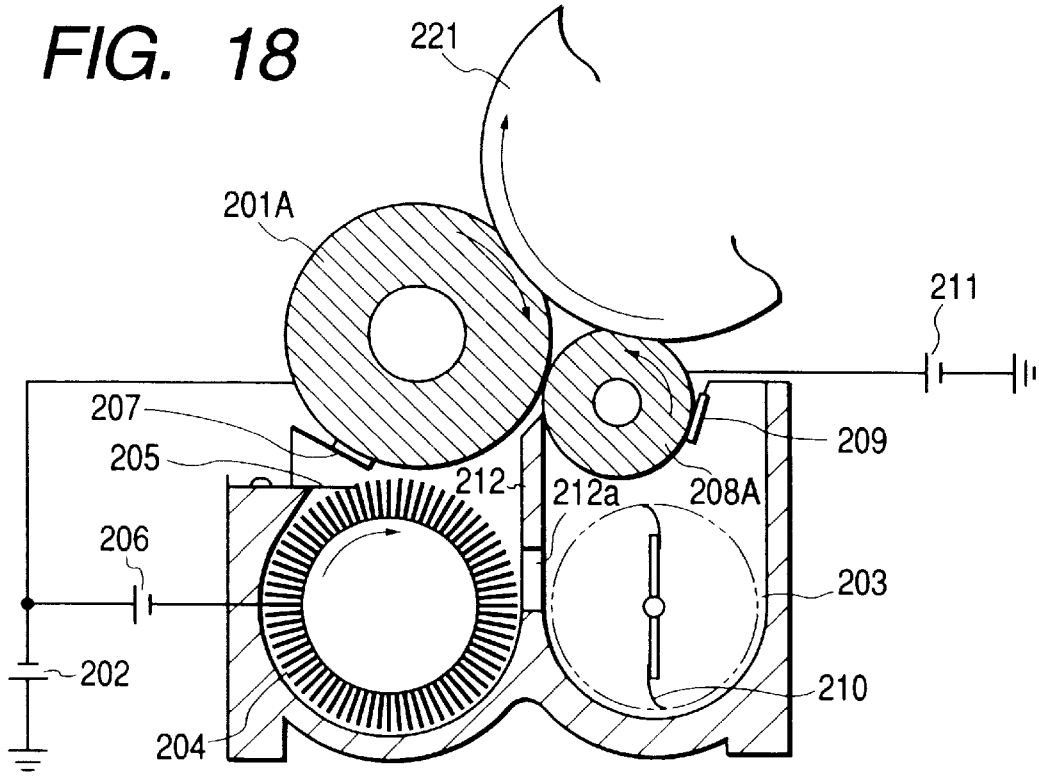
FIG. 18 is a cross-sectional view showing a developing device in still a further embodiment of the present invention.

FIG. 18 is a cross-sectional view showing a developing device in yet still another embodiment of the present invention.

In this embodiment, as in Embodiment 5, the developing roller 201A made of an elastic roller was brought into contact with the photosensitive drum to effect development by the contact developing method. The collection of the untransferred toner on the photosensitive drum, as in Embodiment 3, was carried out in the contact fashion with the toner collecting roller 208A made of an elastic roller being brought into the photosensitive drum, and the collection of the unused toner in development on the developing roller 201A, as in Embodiment 4, was carried out in the contact fashion with the toner collecting roller 208A brought into contact with the developing roller 201A.

Again in the present embodiment, the contact developing method is adopted and therefore, only Vdc=−450V was applied as a developing bias from the voltage source 202 to the developing roller 201A and in contrast therewith, a DC voltage of Vc=+200V or so was applied from the voltage source 211 to the toner collecting roller 208A, and by an electric field formed by the potential difference between these, the unused toner in development on the developing roller 201A was collected onto the toner collecting roller 208A in the contact fashion.

Also, by the action of an electric field formed by the potential of the new electrostatic latent image (exposed portion potential VL=−100V and unexposed portion potential VD=−700V) on the photosensitive drum and the potential of the applied bias to the toner collecting roller 208A, the untransferred toner on the photosensitive drum 201 was collected onto the toner collecting roller 208A in the contact fashion.

Of course, the untransferred toner on the photosensitive drum can be sufficiently collected simply by electrically grounding the toner collecting roller 208A.

Again by the present embodiment, as in Embodiment 5, in the case of the contact developing method in which the developing roller is brought into contact with the photosensitive drum, the collection of the unused toner in development on the developing roller and the untransferred toner on the photosensitive drum becomes possible by the toner collecting roller.

As described above, according to the present embodiment, in an image forming apparatus wherein a plurality of image forming portions each provided with an image bearing member and a non-magnetic monocomponent developing device are installed along transfer material conveying means, and toner images obtained on the image bearing members of the image forming portions are successively superposed one upon another and transferred to the transfer material, the toner is taken in by a toner supplying brush disposed in contact with one end of the toner flow path control member of each developing device, and by the elasticity when the supplying brush comes off the toner flow path control member by the rotation of the supplying brush, the toner is sprung out of the supplying brush and is made into a cloud-like state and also, by an electric field formed between the developing roller and the supplying brush, only the toner having a desired charge amount of the toner made into the cloud-like state is supplied onto the developing roller and therefore, there is not the supply of the toner by the contact and frictional sliding with the developing roller as in the case of the conventional toner supplying roller disposed in contact with the developing roller and thus, the stress to the toner resulting from the supply of the toner to the developing roller can be markedly reduced. Also, of the toner made into the cloud-like state, the toner having a proper charging amount is selectively supplied and therefore, not only the uncharged toner or reversal toner is made difficult to supply, but also the imparting of charges to the toner by the regulating blade may be small and as the result, the contact pressure of the regulating blade can be reduced and the load to the toner can be made reduced.

Also, the unused toner in development returned to the developer container without contributing to development is electrostatically stripped off by the toner collecting roller disposed in non-contact with the developing roller and is reliably returned to the toner containing portion, whereby a circulation path for the toner is formed in the developer container and therefore, the unused toner in development can be prevented from repetitively passing through the nip portion of the regulating blade to thereby apply a continuous load to the toner and thus, the embedding of an extraneous additive into the toner by heat reserve or the like can be remarkably suppressed and the deterioration of the toner can be prevented.

Further, the toner collecting roller can also collect the unused toner in development on the photosensitive drum in the opposed portion to the photosensitive drum and therefore, the cleaning mechanism as used in the prior art can be eliminated for the photosensitive drum, and the downsizing and lower cost of the entire image forming apparatus become possible.

Thus, according to the present embodiment, the load to the toner can be remarkably reduced and color images of high clarity free of fog or the like can be obtained for a long period of time, and the downsizing and lower cost of the entire apparatus become possible.

What is claimed is:

1. An image forming apparatus comprising:

an image bearing member bearing a latent image thereon;

a developing device for developing the latent image borne on said image bearing member with a developer, said developing device having:

a developer bearing member for bearing and carrying the developer thereon, said developer bearing member being provided in opposed relationship with said image bearing member; and developer collecting means provided in opposed relationship with said developer bearing member and said image bearing member; and transfer means for transferring a developer image obtained by developing the latent image by said developing device to a transfer material;

wherein said developer collecting means collects any unused developer in development on said developer bearing member and any untransferred developer on said image bearing member.

2. An image forming apparatus according to claim 1, further comprising developer supplying means provided in non-contact with said developer bearing member for supplying the developer to said developer bearing member.

3. An image forming apparatus according to claim 2, wherein said developer supplying means produces a cloud-like developer near said developer bearing member.

4. An image forming apparatus according to claim 1, wherein said developer collecting means is provided upstream of said developer bearing member with respect to a moving direction of said image bearing member.

5. An image forming apparatus according to claim 1, wherein said developer collecting means is provided downstream of said developer bearing member with respect to the moving direction of said image bearing member.

6. An image forming apparatus according to claim 1, wherein said developer is a non-magnetic monocomponent developer.

7. An image forming apparatus according to claim 2, wherein a bias voltage comprising an AC voltage superimposed on a DC voltage is applied to said developer bearing member.

8. An image forming apparatus according to claim 7, wherein a voltage comprising a DC voltage superimposed on the bias voltage applied to said developer bearing member is applied to said developer supplying means, and an electric field is formed between said developer supplying means and said developer bearing member.

9. An image forming apparatus according to claim 1, wherein said developer collecting means is not in contact with said developer bearing member and said image bearing member.

10. An image forming apparatus according to claim 9, wherein an interval between said developer collecting means and said developer bearing member is 0.1 mm to 1 mm, and an interval between said developer collecting means and said image bearing member is 0.1 mm to 1 mm.

11. An image forming apparatus according to claim 9, wherein the unused developer in development on said developer bearing member and the untransferred developer on said image bearing member are collected onto said developer collecting means by an action of an electric field formed between said developer collecting means and said developer bearing member and an action of an electric field formed between said developer collecting means and said image bearing member, respectively.

12. An image forming apparatus according to claim 1, wherein a direction of rotation of said developer collecting means and a direction of rotation of said developer bearing member are opposite to each other, and the direction of rotation of said developer collecting means and a direction of rotation of said image bearing member are also opposite to each other.

13. An image forming apparatus according to claim 1, wherein said developer collecting means is a metallic roller having its surface worked into a mirror surface.

14. An image forming apparatus according to claim 1, wherein said developer collecting means is a metallic roller having its surface processed by resin.

15. An image forming apparatus according to claim 1, comprising a plurality of said image bearing members, a plurality of said developing devices and a plurality of said transfer means arranged to form a color image.

16. An image forming apparatus according to claim 1, wherein said developer collecting means is not in contact with said developer bearing member, but is in contact with said image bearing member.

17. An image forming apparatus according to claim 16, wherein said developer collecting means is an elastic roller having an elastic layer.

18. An image forming apparatus according to claim 1, wherein said developer collecting means is in contact with said developer bearing member, and is not in contact with said image bearing member.

19. An image forming apparatus according to claim 1, wherein said developer collecting means is in contact with said developer bearing member and said image bearing member.

* * * * *

UNITED STATES PATENT AND TRADEMARK OFFICE

CERTIFICATE OF CORRECTION

PATENT NO. : 6,272,302 B1
DATED : August 7, 2001
INVENTOR(S) : Takeshi Yamamoto

It is certified that error appears in the above-identified patent and that said Letters Patent is hereby corrected as shown below:

Column 1,
Line 18, “are” should read -- is --.

Column 2,
Line 43, “which” should read -- wherein --.

Column 3,
Line 55, “progressed,” should read -- proposed, --.

Column 9,
Line 61, “by the” should be deleted.

Column 18,
Line 51, “Vc=+45V” should read -- Vc=+450V --.

Signed and Sealed this

Twenty-fifth Day of June, 2002

*Attest:*

*Attesting Officer*

JAMES E. ROGAN
*Director of the United States Patent and Trademark Office*